US009354567B2

(12) United States Patent
Waida et al.

(10) Patent No.: US 9,354,567 B2
(45) Date of Patent: May 31, 2016

(54) FIXING DEVICE, FIXING DEVICE CONTROL METHOD, AND IMAGE FORMING APPARATUS

(75) Inventors: Takumi Waida, Tokyo (JP); Ryota Yamashina, Kanagawa (JP); Yasunori Ishigaya, Kanagawa (JP); Masahiro Samei, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 697 days.

(21) Appl. No.: 13/272,629

(22) Filed: Oct. 13, 2011

(65) Prior Publication Data

US 2012/0093534 A1 Apr. 19, 2012

(30) Foreign Application Priority Data

Oct. 13, 2010 (JP) ..... 2010-230419
May 11, 2011 (JP) ..... 2011-106196

(51) Int. Cl.
*G03G 15/20* (2006.01)

(52) U.S. Cl.
CPC ..... *G03G 15/2046* (2013.01)

(58) Field of Classification Search
USPC ..... 399/69, 70, 328
See application file for complete search history.

(56) References Cited

U.S. PATENT DOCUMENTS 5,742,865 A * 4/1998 Yajima et al. ..... 399/43
7,912,392 B2 3/2011 Yoshinaga et al.
2007/0217803 A1 * 9/2007 Nakayama ..... 399/68
2009/0169232 A1 7/2009 Kunii et al.
2009/0297199 A1 12/2009 Yamashina et al.
2010/0061754 A1 3/2010 Ishigaya et al.
2010/0092220 A1 4/2010 Hasegawa et al.
2010/0092221 A1 4/2010 Shinshi et al.

(Continued)

FOREIGN PATENT DOCUMENTS

JP 60-150075 8/1985
JP 62-144177 6/1987

(Continued)

OTHER PUBLICATIONS

Computer translation of Kimura et al., filed Feb. 1999, JP11-030928A.*

(Continued)

*Primary Examiner* — Quana M Grainger
(74) *Attorney, Agent, or Firm* — Oblon, McClelland, Maier & Neustadt, L.L.P.

(57) ABSTRACT

A fixing device includes a rotatable fuser member a heater, a rotatable pressure member, a thermometer, and a feedback controller. The rotatable fuser member is subjected to heating. The heater heats the fuser member to a heating temperature. The rotatable pressure member is disposed opposite the fuser member. The fuser member and the pressure member are pressed against each other to form a fixing nip therebetween, through which the recording medium is conveyed, so as to fix the toner image in place under heat and pressure. The thermometer is disposed adjacent to the pressure member to detect an operational temperature of the pressure member. The feedback controller is operatively connected with the thermometer to control the heating temperature according to the detected operational temperature, so that the recording medium exhibits a substantially constant post-fixing temperature downstream from the fixing nip regardless of the heat capacity of the recording medium.

7 Claims, 17 Drawing Sheets

(56) References Cited

U.S. PATENT DOCUMENTS

| | | | |
|---|---|---|---|
| 2011/0052224 | A1 | 3/2011 | Yamashina et al. |
| 2011/0064437 | A1 | 3/2011 | Yamashina et al. |
| 2011/0091226 | A1 | 4/2011 | Ishigaya et al. |
| 2011/0182634 | A1 | 7/2011 | Ishigaya et al. |
| 2011/0206402 | A1 | 8/2011 | Yamashina |
| 2011/0217057 | A1 | 9/2011 | Yoshinaga et al. |
| 2011/0222927 | A1 | 9/2011 | Yamashina |

FOREIGN PATENT DOCUMENTS

| | | | | |
|---|---|---|---|---|
| JP | 6-308854 | A | | 11/1994 |
| JP | 7-230231 | A | | 8/1995 |
| JP | 10-198216 | A | | 7/1998 |
| JP | 11030928 | A | * | 2/1999 |
| JP | 11-338289 | | | 12/1999 |
| JP | 3535587 | | | 3/2004 |
| JP | 2004-258654 | A | | 9/2004 |
| JP | 2005-84419 | | | 3/2005 |
| JP | 2006-195422 | | | 7/2006 |
| JP | 2009-187020 | | | 8/2009 |

OTHER PUBLICATIONS

U.S. Appl. No. 13/109,346, filed May 17, 2011, Yasunori Ishigaya, et al.

U.S. Appl. No. 13/252,543, filed Oct. 4, 2011, Yasunori Ishigaya, et al.

Office Action issued Feb. 24, 2015 in Japanese Application No. 2011-106196.

Extended European Search Report issued Feb. 1, 2012 in patent application No. 11185036.8.

* cited by examiner

FIXING DEVICE, FIXING DEVICE CONTROL METHOD, AND IMAGE FORMING APPARATUS

CROSS-REFERENCE TO RELATED APPLICATIONS

This patent application claims priority pursuant to 35 U.S.C. §119 to Japanese Patent Applications Nos. 2010-230419 and 2011-106196, filed on Oct. 13, 2010 and May 11, 2011, respectively, the entire disclosure of each of which is hereby incorporated by reference herein.

BACKGROUND OF THE INVENTION

1. Field of the Invention

The present invention relates to a fixing device, a fixing device control method, and an image forming apparatus, and more particularly, to a fixing device that fixes a toner image in place on a recording medium with heat and pressure, a control method for use in such a fixing device, and an electrophotographic image forming apparatus, such as a photocopier, facsimile machine, printer, plotter, or multifunctional machine incorporating several of those imaging functions, which employs a fixing device with a heating control capability.

2. Description of the Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and setting the toner with heat and pressure.

Various types of fixing devices are known in the art, most of which employ a pair of generally cylindrical looped belts or rollers, one being heated for fusing toner ("fuser member") and the other being pressed against the heated one ("pressure member"), which together form a heated area of contact called a fixing nip through which a recording medium is passed to fix a toner image onto the medium under heat and pressure.

Those types of fixing devices may be operated with different types of recording media varying in terms of basis weight or mass per unit area, surface properties imparted, for example, by coating material, etc., depending on specific requirements of print jobs being processed. Also, the fixing device can experience varying operational conditions depending on specific applications of an image forming system in which the process is installed. For example, some printers execute print jobs at a low processing speed with an elongated period of deactivation between consecutive print jobs, and others execute a large number of print jobs at a high processing speed sequentially and continuously.

The inventors have recognized that such variations in operational conditions can result in variations in the amount of heat applied through the fixing nip. This is particularly true with a today's power-efficient fixing device that has a heater for heating a fuser member to a regulated heating temperature but no dedicated heater for a pressure member, wherein the pressure member exhibits a relatively low heat capacity and therefore is susceptible to variations in operational temperature. Variations in the amount of heat applied through the fixing nip often take place due to variations in operational temperature of the pressure member, which can result in excessive amounts of heat applied to the recording medium. Inconsistent heating through the fixing nip, if not corrected, would adversely affect quality of the toner image processed through the fixing device, since good fixing performance depends on the ability to heat a recording medium to a consistent, desired temperature sufficient for fusing and melting toner particles through the fixing nip.

To date, various methods have been proposed to provide a fixing process controllable against variations in environmental and operational conditions.

For example, an image forming apparatus may be given a controller that modifies a control parameter of an electrophotographic imaging process based on user-specified information representing properties of a recording medium in use. Alternatively, an image forming apparatus may employ a controller that controls operation of a fixing process based on physical properties of a recording medium, such as surface texture, thickness, moisture content, etc., detected during operation.

BRIEF SUMMARY OF THE INVENTION

Exemplary aspects of the present invention are put forward in view of the above-described circumstances, and provide a novel fixing device for fixing a toner image printed on a recording medium having a specific heat capacity.

In one exemplary embodiment, the fixing device includes a rotatable fuser member a heater, a rotatable pressure member, a thermometer, and a feedback controller. The rotatable fuser member is subjected to heating. The heater heats the fuser member to a heating temperature. The rotatable pressure member is disposed opposite the fuser member. The fuser member and the pressure member are pressed against each other to form a fixing nip therebetween, through which the recording medium is conveyed with a first, printed surface thereof facing the fuser member and a second, non-printed surface thereof facing the pressure member, so as to fix the toner image in place under heat and pressure as the fuser and pressure members rotate together. The thermometer is disposed adjacent to the pressure member to detect an operational temperature of the pressure member. The feedback controller is operatively connected with the thermometer to control the heating temperature according to the detected operational temperature, so that the recording medium exhibits a substantially constant post-fixing temperature downstream from the fixing nip regardless of the heat capacity of the recording medium.

Other exemplary aspects of the present invention are put forward in view of the above-described circumstances, and provide a novel method for use in a fixing device.

In one exemplary embodiment, the fixing device that fixes a toner image printed on a recording medium having a specific heat capacity, and includes a rotatable fuser member subjected to heating to a heating temperature, and a rotatable pressure member disposed opposite the fuser member. The fuser member and the pressure member are pressed against each other to form a fixing nip therebetween. The method includes the steps of conveyance, detection, and control. The conveyance step conveys the recording medium under heat and pressure through the fixing nip. The detection step detects an operational temperature of the pressure member during passage of the recording medium through the fixing nip. The control step controls the heating temperature according to the detected operational temperature, so that the recording medium exhibits a substantially constant post-fixing temperature downstream from the fixing nip regardless of the heat capacity of the recording medium.

Still other exemplary aspects of the present invention are put forward in view of the above-described circumstances, and provide an image forming apparatus incorporating a fixing device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
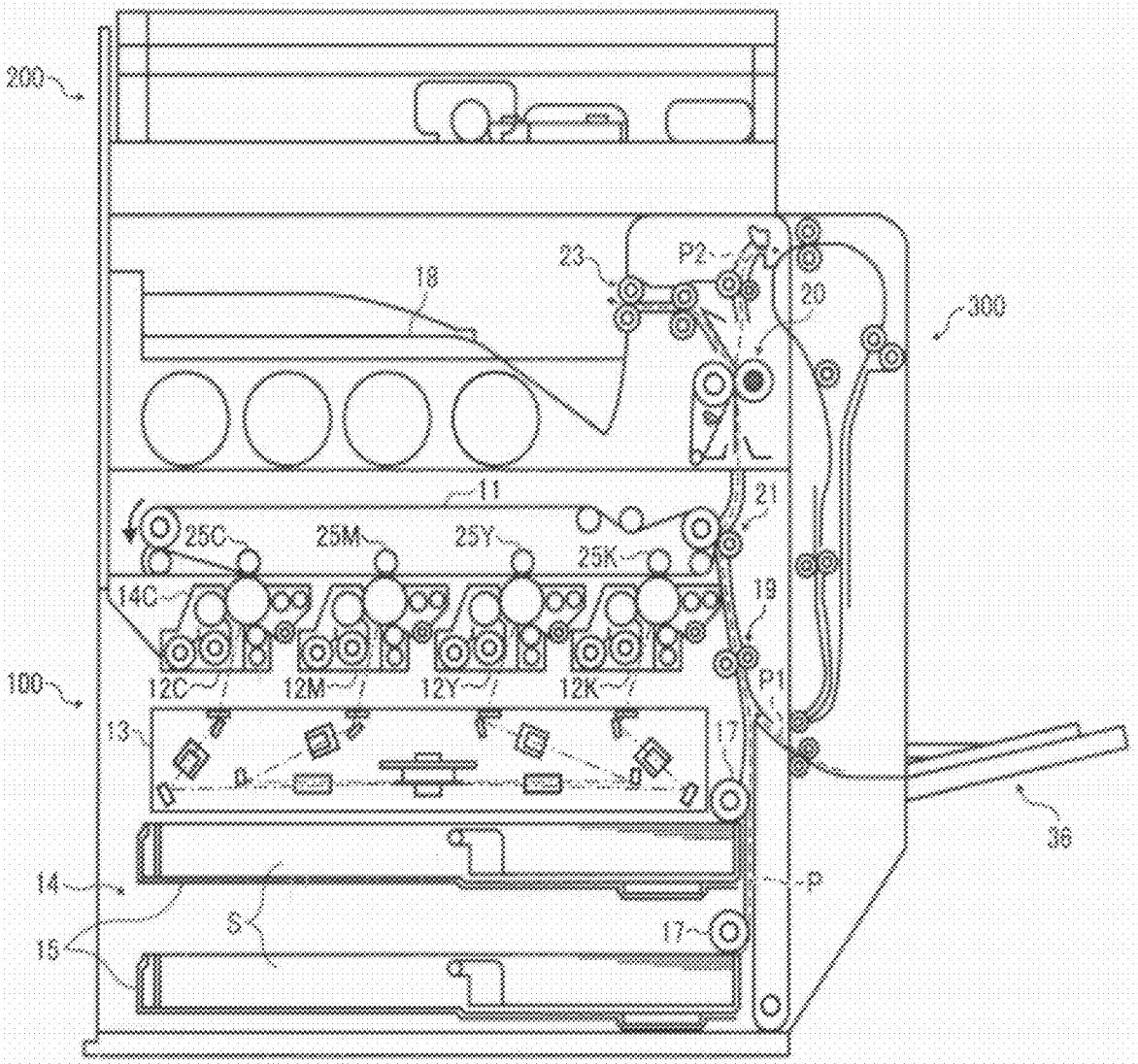
FIG. 1 schematically illustrates an image forming apparatus incorporating a fixing device according to this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 100 incorporating a fixing device 20 according to this patent specification.

As shown in FIG. 1, the image forming apparatus 100 is a digital color imaging system that can print a color image on a recording medium such as a sheet of paper S according to image data, provided with an image scanner 200 located atop the apparatus body to capture image data from an original document, as well as a media reversal unit 300 attached to a side of the apparatus body to allow reversing a recording sheet S during duplex printing.

The image forming apparatus 100 comprises a tandem color printer that forms a color image by combining images of yellow, magenta, and cyan (i.e., the complements of three subtractive primary colors) as well as black, consisting of four electrophotographic imaging stations 12C, 12M, 12Y, and 12K arranged in series substantially laterally along the length of an intermediate transfer belt 11, each forming an image with toner particles of a particular primary color, as designated by the suffixes "C" for cyan, "M" for magenta, "Y" for yellow, and "K" for black.

Each imaging station 12 includes a drum-shaped photoconductor rotatable counterclockwise in the drawing, facing a laser exposure device 13 therebelow, while surrounded by various pieces of imaging equipment, such as a charging device, a development device, a transfer device incorporating an electrically biased, primary transfer roller 25, a cleaning device for the photoconductive surface, etc., which work in cooperation to form a primary toner image on the photoconductor 3 for subsequent transfer to the intermediate transfer belt 11 at a primary transfer nip defined between the photoconductive drum and the primary transfer roller 25.

The intermediate transfer belt 11 is trained around multiple support rollers to rotate counterclockwise in the drawing, passing through the four primary transfer nips sequentially to carry thereon a multi-color toner image toward a secondary transfer nip defined between a secondary transfer roller 21 and a belt support roller.

Below the laser exposure device 13 is a sheet conveyance mechanism 14 including one or more input sheet trays 15 each accommodating a stock of recording media such as paper sheets S and equipped with a feed roller 17. The sheet conveyance mechanism 14 also includes a pair of registration rollers 19, an output unit formed of a pair of output rollers 23, an in-body, output sheet tray 18 located underneath the image scanner 200, and other guide rollers or plates disposed between the input and output trays 15 and 18, which together define a primary, sheet conveyance path P for conveying a recording sheet S from the input tray 15, between the registration rollers 19, then through the secondary transfer nip, then through the fixing device 20, and then between the output rollers 23 to the output tray 18. A pair of secondary, sheet conveyance paths P1 and P2 are also defined in connection with the primary path P, the former for re-introducing a sheet S into the primary path P after processing through the reversal unit 300 or upon input in a manual input tray 36, and the latter for introducing a sheet S from the primary path P into the reversal unit 300 downstream from the fixing device 20.

During operation, the image forming apparatus 100 can perform printing in various print modes, including a monochrome print mode and a full-color print mode, as specified by a print job received from a user.

In full-color printing, each imaging station 12 rotates the photoconductor drum clockwise in the drawing to forward its outer, photoconductive surface to a series of electrophotographic processes, including charging, exposure, development, transfer, and cleaning, in one rotation of the photoconductor drum.

First, the photoconductive surface is uniformly charged by the charging roller and subsequently exposed to a modulated laser beam emitted from the exposure device 13. The laser exposure selectively dissipates the charge on the photoconductive surface to form an electrostatic latent image thereon according to image data representing a particular primary color. Then, the latent image enters the development device which renders the incoming image visible using toner. The toner image thus obtained is forwarded to the primary transfer nip at which the incoming image is transferred to the intermediate transfer belt 11 with an electrical bias applied to the primary transfer roller 25.

As the multiple imaging stations 12 sequentially produce toner images of different colors at the four transfer nips along the belt travel path, the primary toner images are superimposed one atop another to form a single multicolor image on the moving surface of the intermediate transfer belt 11 for subsequent entry to the secondary transfer nip between the secondary transfer roller 21 and the belt support roller.

Meanwhile, the sheet conveyance mechanism 14 picks up a recording sheet S from atop the sheet stack in the sheet tray 15 to introduce it between the pair of registration rollers 19 being rotated. Upon receiving the incoming sheet S, the registration rollers 19 stop rotation to hold the sheet S therebetween, and then advance it in sync with the movement of the intermediate transfer belt 11 to the secondary transfer nip at which the multicolor image is transferred from the belt 11 to the recording sheet S with an electrical bias applied to the secondary transfer roller.

After secondary transfer, the recording sheet S is introduced into the fixing device 20 to fix the toner image in place under heat and pressure. The recording sheet S, thus having its first side printed, is forwarded to a sheet diverter, which directs the incoming sheet S to an output roller pair 23 for output to the in-body output tray 18 along the primary path P when simplex printing is intended, or alternatively, to the media reversal unit 300 along the secondary path P2 when duplex printing is intended.

For duplex printing, the reversal unit 300 turns over the incoming sheet S for reentry to the sheet conveyance path P along the secondary path P1, wherein the reversed sheet S again undergoes electrophotographic imaging processes including registration through the registration roller pair 19, secondary transfer through the secondary transfer nip, and fixing through the fixing device 100 to form another print on its second side opposite the first side.

Upon completion of simplex or duplex printing, the recording sheet S is output to the in-body output tray 18 for stacking inside the apparatus body, which completes one operational cycle of the image forming apparatus 100.

Figure 2:
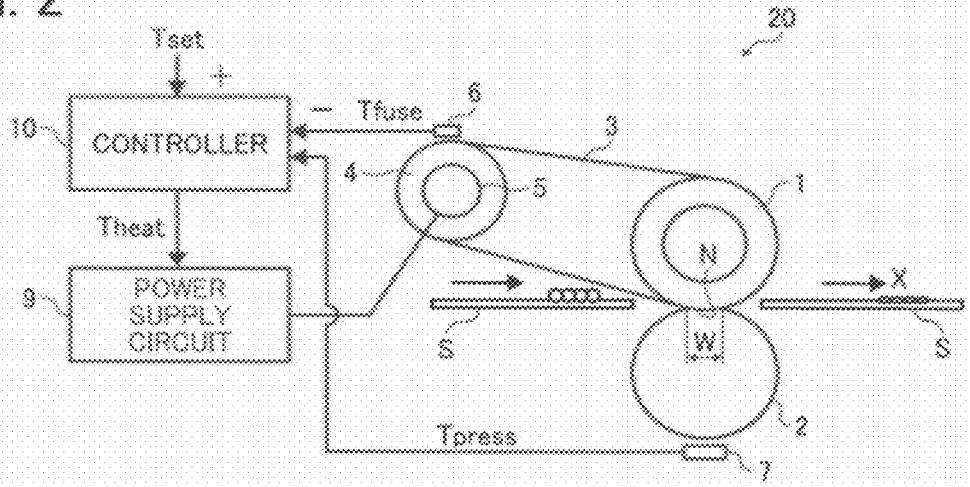
FIG. 2 is an end-on, axial cutaway view schematically illustrating the fixing device according to one embodiment of this patent specification.

FIG. 2 is an end-on, axial cutaway view schematically illustrating the fixing device 20 according to a first embodiment of this patent specification.

As shown in FIG. 2, the fixing device 20 includes a fuser roller 1; a heat roller 4, disposed parallel to the fuser roller 1, having a circumference thereof heated by a heater 5; an endless, fuser belt 3 looped for rotation around the fuser roller 1 and the heat roller 4; and a pressure roller 2 disposed opposite the fuser roller 1 with the fuser belt 3 interposed between the pressure roller 2 and the fuser roller 1 to form a fixing nip N therebetween.

At least one of the opposing rollers 1 and 2 forming the fixing nip N is stationary or fixed in position with its rotational axis secured in position to a frame or enclosure of the apparatus body, whereas the other can be positioned with its rotational axis movable while elastically biased against the opposite roller, so that moving the positionable roller relative to the stationary roller allows adjustment of a width w of contact between the fuser and pressure members, across which the fixing nip N extends in a direction X of conveyance of a recording sheet S.

In the present embodiment, the heat roller 4 comprises a hollow cylindrical body of thermally conductive material within which the heater 5 is accommodated. The heater 5 may be any suitable heat source, including electrical resistance heater, such as a halogen lamp or a ceramic heater, as well as electromagnetic induction heater (IH), which produces heat according to a duty cycle or power supply being input per unit of time. The heat roller 4 in conjunction with the internal heater 5 serves to heat the fuser belt 3 as the belt 3 rotates around the internally heated roller 4.

The pressure roller 2 comprises a cylindrical body of sponged material that has relatively low thermal capacity, with no dedicated heater disposed adjacent to the pressure roller 2. Alternatively, instead, the pressure roller 2 may have a dedicated heater, in which case the heater serves to maintain the pressure roller 2 at a sufficiently high temperature to allow immediate activation of the fixing device after an extended period of deactivation.

During operation, the fuser roller 1 rotates in a given rotational direction (i.e., counterclockwise in the drawing) to rotate the fuser belt 3 in the same rotational direction, which in turn rotates the pressure roller 2 in the opposite rotational direction (i.e., clockwise in the drawing). The heat roller 4 is internally heated by the heater 5 to heat a length of the rotating belt 3 to a heating temperature Theat, so as to sufficiently heat and melt toner particles through the fixing nip N.

As the rotary fixing members rotate together, a recording sheet S bearing an unfixed, powder toner image passes through the fixing nip N in the sheet conveyance direction X to fix the toner image in place, wherein heat from the fuser belt 3 causes toner particles to fuse and melt, while pressure from the pressure roller 2 causes the molten toner to settle onto the sheet surface.

Throughout the fixing process, the recording sheet S moves at a given conveyance speed V, and resides in the fixing nip N during a period of nip dwell time t depending on the conveyance speed V and the width w of the fixing nip N. The recording sheet S after fixing exits the fixing nip N to reach a post-fixing position PF downstream from the fixing nip N where the sheet S exhibits a post-fixing temperature Tpf depending on the amount of heat applied through the fixing nip N.

As used herein, the term "post-fixing temperature" describes a temperature of a recording medium at a post-fixing position adjacent to and immediately downstream from an exit of a fixing nip, which can be obtained through measurement using a thermometer detecting temperature of the recording medium at the post-fixing position, or through estimation based on readings of a thermometer detecting temperature outside the fixing nip as well as one or more operational parameters related to heating of the recording medium. Also, the term "nip dwell time" herein denotes a period of time during which a particular imaginary point in the recording medium conveyed at a particular conveyance speed passes across the entire width of the fixing nip, which may be obtained by dividing the width of the fixing nip by the conveyance speed of the recording medium.

Quality of a toner image fixed on a recording medium is dictated by various factors, such as adhesion of toner to the recording medium, which determines resistance against undesired transfer or flaking of toner off the printed surface, as well as surface texture or glossiness of toner fused and solidified on the recording medium. The inventors have recognized that such quality factors of the fixing process is highly correlated with the post-fixing temperature, which well reflects an amount of heat applied to the recording medium through the fixing nip to cause toner to exhibit adhesion and gloss after completion of the fixing process.

Experiments I and II

Figure 3:
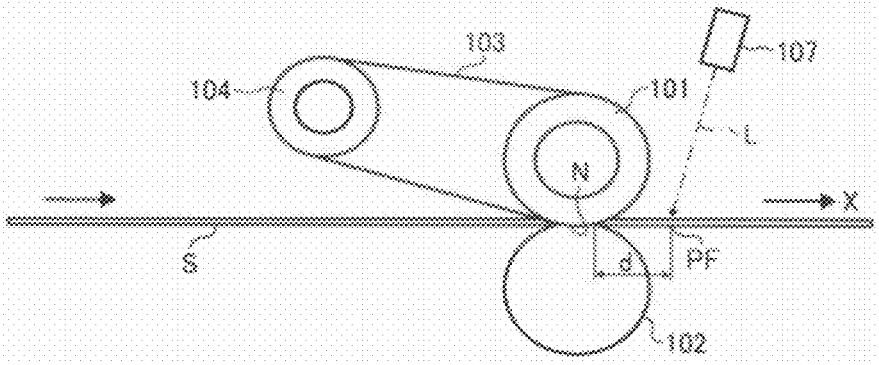
FIG. 3 is an end-on, axial cutaway view of equipment used in experiments for investigating a relation between post-fixing temperature and imaging quality of a fixing process.

Experiments have been conducted to investigate a relation between post-fixing temperature and imaging quality of a fixing process as dictated by adhesion and glossiness exhibited by toner fixed onto a recording medium, using experimental equipment as shown in FIG. 3.

As shown in FIG. 3, the experimental equipment comprises a belt-based fixing device similar to that depicted in FIG. 2, including a fuser belt 103 entrained around multiple rollers 101 and 104, and paired with a pressure roller 102 to form a fixing nip N therebetween. A recording sheet S is conveyed in a sheet conveyance direction X through the fixing nip N.

Downstream from the fixing nip N is a thermometer 107, comprising a thermal radiation, non-contact temperature sensor with laser sighting, model FT-H20, commercially available and manufactured by Keyence Corporation, which can measure temperature by sensing thermal radiation from an object aimed at with a laser beam L.

The thermometer 107 was used to measure a post-fixing temperature of the recording sheet S with its laser beam L directed to a post-fixing position PF at a distance d from a downstream end of the fixing nip N. The distance d was sufficiently short, so as to precisely measure the temperature immediately after exiting the fixing nip N, for example, ranging from approximately 10 mm to approximately 30 mm, which was equivalent to a time interval of approximately 50 msec to approximately 300 msec during which the recording sheet S proceeded at a typical conveyance speed through the fixing process.

Figure 4:
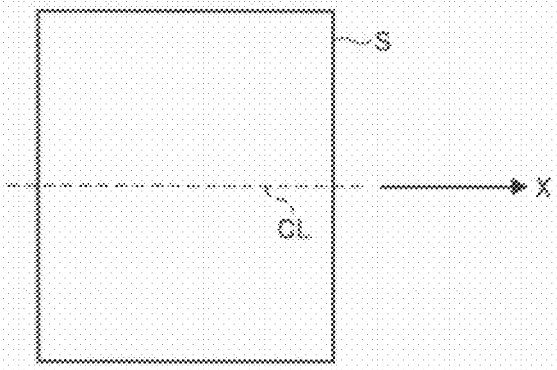
FIG. 4 is a plan view of a recording medium processed in the experimental equipment of FIG. 3.

With additional reference to FIG. 4, the recording sheet S used was an A4-size copy sheet directed with its shorter edges aligned with the conveyance path, so that the laser beam L followed an imaginary center line CL parallel to the shorter edges of the recording sheet S moving in the conveyance direction X.

Figure 5:
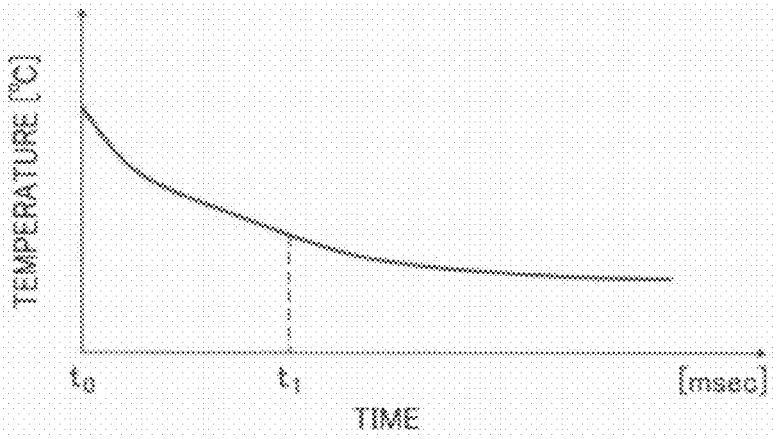
FIG. 5 is a graph showing exemplary temperature in degrees Celsius which a particular observed point of a recording medium conveyed downstream from a fixing nip typically exhibits, plotted against time in milliseconds.

FIG. 5 is a graph showing exemplary temperature in degrees Celsius which a particular observed point of the recording sheet S conveyed downstream from the fixing nip N typically exhibits, plotted against time in milliseconds, wherein time "$t_0$" denotes a point in time at which the observed point passes through the downstream end of the fixing nip N, and "$t_1$" denotes a point in time at which the observed point reaches the post-fixing position PF to meet the laser beam L. As shown in FIG. 5, the temperature gradually decreases from time $t_0$ to time $t_1$, as the recording sheet S cools due to exposure to atmosphere during conveyance after exiting the fixing nip N.

Figure 6:
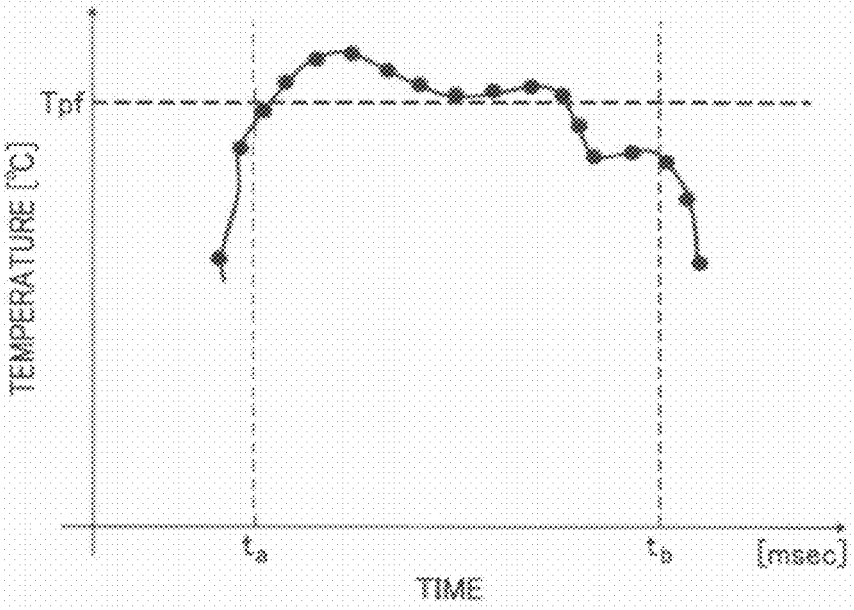
FIG. 6 is a graph showing readings of a thermometer measuring temperature of a recording sheet during the experiments using the experimental equipment of FIG. 3.

FIG. 6 is a graph showing readings of the thermometer 107 measuring temperature of a recording sheet S at a sampling cycle of 10 msec during experiments, wherein "$t_a$" denotes a point in time at which the laser beam L initially meets the sheet S reaching the post-fixing position PF, and "$t_b$" denotes a point in time at which the laser beam L finally meets the sheet S leaving the post-fixing position PF.

As shown in FIG. 6, measurements observed in the time interval between $t_a$ and $t_b$ (i.e., a duration of time during which the entire circumference of the laser spot L is located between the leading and trailing edges of the recording sheet S) vary from one to another to together form an irregular curve. A post-fixing temperature was determined as an average of multiple measurements made by the thermometer 107, as a single recording sheet S reached and left the post-fixing position PF. In this case, the temperatures observed between times $t_a$ and $t_b$ were averaged to obtain a post-fixing temperature Tpf for the recording sheet S.

Figure 7A:
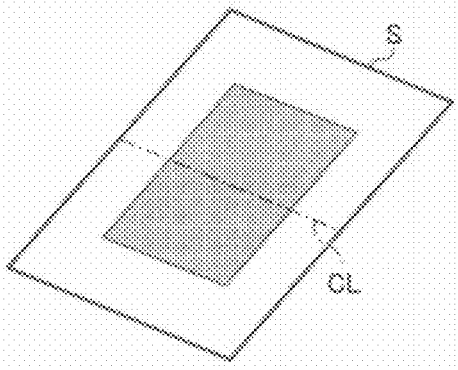
FIGS. 7A through 7D schematically illustrate preparation of a printed image sample for evaluation of toner adhesion in the experiments using the experimental equipment of FIG. 3.

In Experiment I, the experimental equipment depicted in FIG. 3 was operated to fix a solid, monotonous image on a recording sheet of paper having a basis weight or grammage per square meter of 90 g/m$^2$, while measuring a post-fixing temperature Tpf for the recording sheet S. Printing was carried out under the following environmental/operational conditions: ambient temperature of 23° C.; humidity of 50%; and heating temperature of 180° C. A sample print thus obtained was prepared for evaluation in a manner depicted below with reference to FIGS. 7A thorough 7D.

Figure 7B:
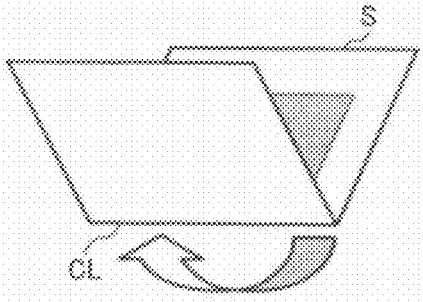
Figure 7C:
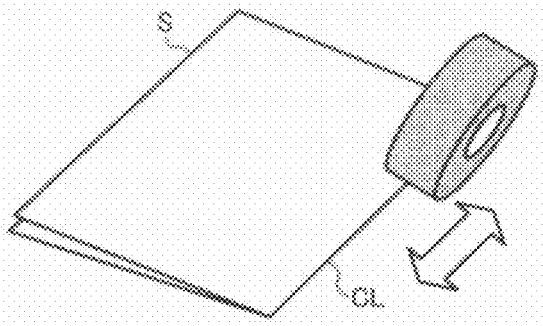
Figure 7D:
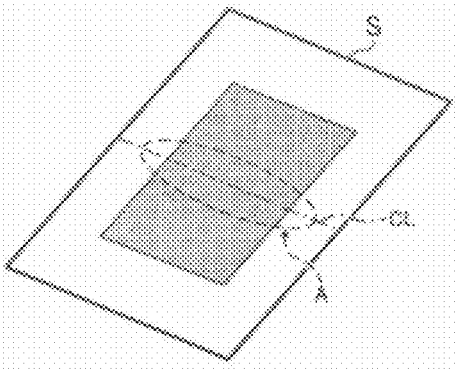

Specifically, the recording sheet S was first marked with a centerline CL (FIG. 7A), then folded in two along the marking CL (FIG. 7B), and then rolled out twice (i.e., from one side to the other and then back again) along the fold line CL with a one-kilogram weight in the shape of a cylinder 50 millimeters in height (FIG. 7C), thereby establishing an inspection area A around the fold line CL at the substantial center of the printed recording sheet (FIG. 7D). With the inspection area A thus determined, the printed surface was wiped with cloth, and then swept off to remove any dust resulting from frictional contact with the wiping material.

Figure 8:
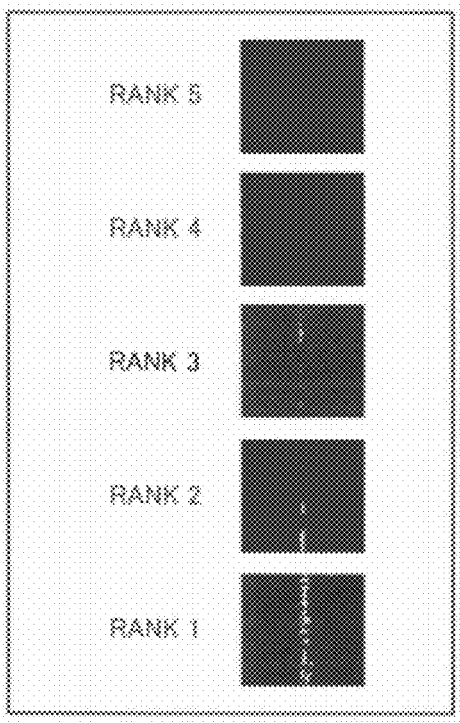
FIG. 8 is a view of patches of reference images against which a printed image sample was compared for evaluation of toner adhesion in the experiments using the experimental equipment of FIG. 3.

Multiple image samples were prepared in a similar manner, each of which was subjected to visual inspection, in which the toner image was evaluated in terms of adhesion of toner to the recording sheet through comparison with patches of reference images, numerically rated and ranked from "1" having significant flake-off of toner, denoting a lowest level of toner adhesion, to "5" with substantially no toner flaking, denoting a highest level of toner adhesion, as shown in FIG. 8

Figure 9:
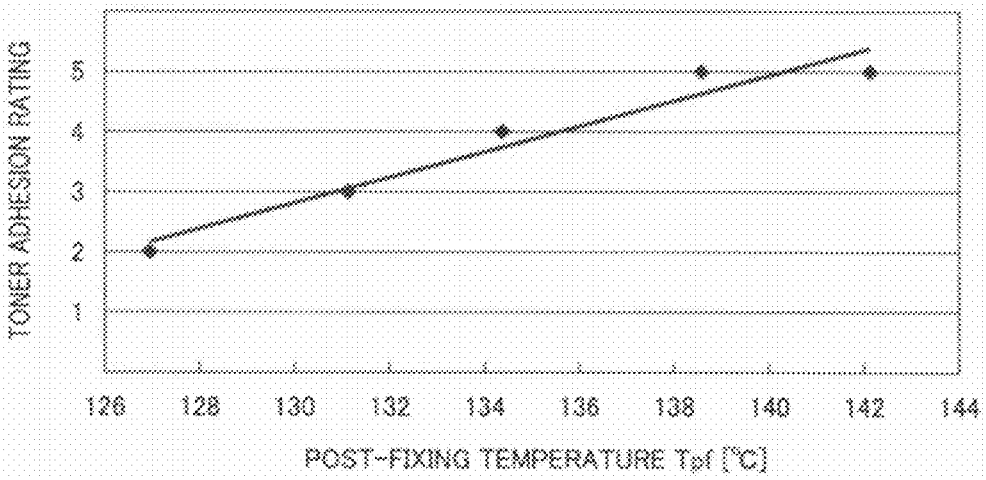
FIG. 9 is a graph showing experimental results, in which numerical rating of toner adhesion is plotted against post-fixing temperature in degrees Celsius.

FIG. 9 is a graph showing results of Experiment I, in which the numerical rating of toner adhesion is plotted against the post-fixing temperature Tpf in degrees Celsius.

As shown in FIG. 9, the toner adhesion generally improves as the post-fixing temperature Tpf increases, yielding a strong linear correlation between the toner adhesion rating and the post-fixing temperature Tpf with an $R^2$ of 0.9445, i.e., nearly equal to 1. Thus, the strength of toner adhesion is linearly and strongly correlated with the post-fixing temperature Tpf.

In Experiment II, the experimental equipment depicted in FIG. 3 was operated to fix a solid, monotonous image on a recording sheet of paper having a basis weight or grammage per square meter of 90 g/m$^2$, while measuring a post-fixing temperature Tpf for the recording sheet S. Printing was carried out under the following environmental/operational conditions: ambient temperature of 23° C.; humidity of 50%; heating temperature of 180° C.

Multiple image samples were prepared in a similar manner, each of which was subjected to visual inspection, in which the toner image was evaluated in terms of glossiness measured using a commercially available glossmeter.

Figure 10:
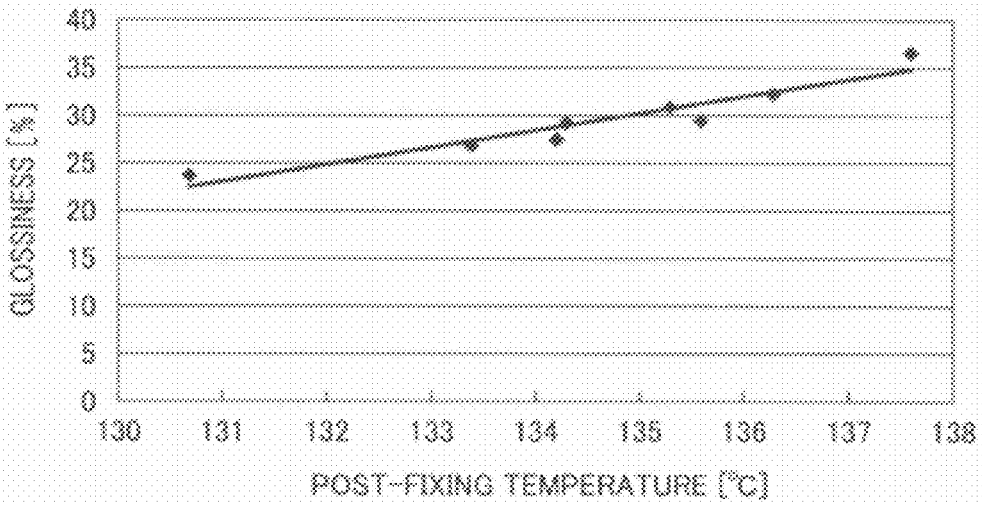
FIG. 10 is a graph showing experimental results, in which image glossiness in percent is plotted against post-fixing temperature in degrees Celsius.

FIG. 10 is a graph showing results of Experiment II, in which the image glossiness in percent is plotted against the post-fixing temperature Tpf in degrees Celsius.

As shown in FIG. 10, the image glossiness generally increases as the post-fixing temperature Tpf increases, yielding a strong linear correlation between the image glossiness and the post-fixing temperature. In this particular case, the linear graph has a slope of 1.5, so that a change of 10 degrees in post-fixing temperature is accompanied with a change of 15% in image glossiness. Thus, the degree of image glossiness is linearly and strongly correlated with the post-fixing temperature Tpf.

The Experiments I and II demonstrate that there is a strong linear correlation between the post-fixing temperature Tpf and the imaging quality dictated by toner adhesion and image glossiness. Such experimental results indicate that the post-fixing temperature Tpf can be used to precisely indicate, measure, or control an amount of heat applied through the fixing nip N, which causes toner to exhibit adhesion and gloss after completion of the fixing process.

That is, variations in the post-fixing temperature Tpf indicate variations in the amount of heat applied through the fixing nip N, leading to inconsistent imaging quality as well as excessive heat and power wasted during operation, where an undue amount of heat is applied to a recording medium which then exhibits a post-fixing temperature higher than that originally designed. Maintaining the post-fixing temperature Tpf to a desired, constant temperature is therefore required not only to maintain a consistent imaging performance but also to provide an energy-efficient thermal fixing process.

Figure 11:
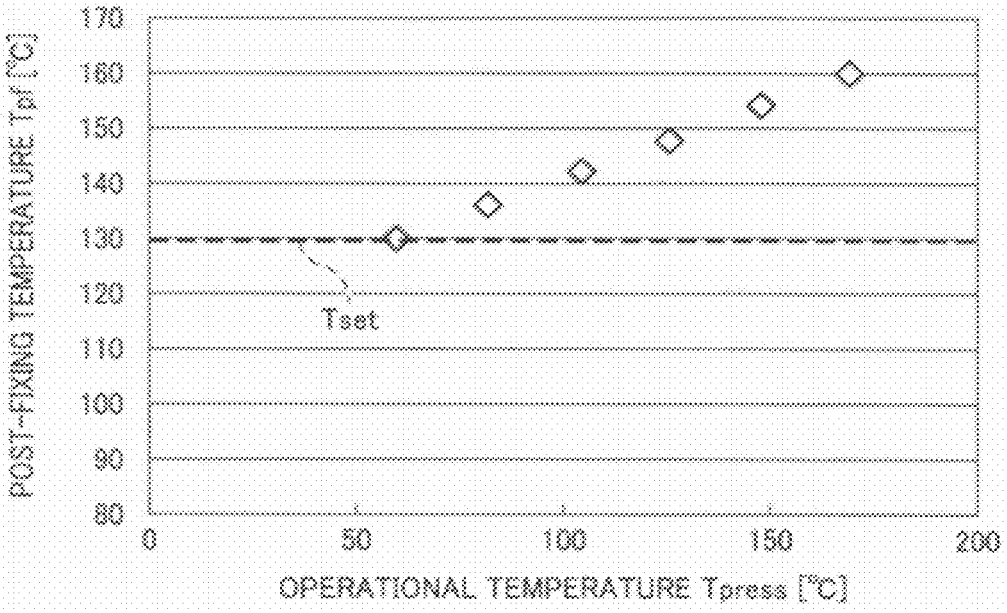
FIG. 11 is a graph showing a post-fixing temperature plotted against an operational temperature of a pressure member, both in degrees Celsius, measured in a fixing device.

FIG. 11 is a graph showing a post-fixing temperature Tpf plotted against an operational temperature Tpress of a pressure member, both in degrees Celsius, measured in a fixing device where a heater or heating controller is provided solely to a fuser member to maintain a constant heating temperature of 180° C.

As shown in FIG. 11, the post-fixing temperature Tpf changes substantially proportionally with the pressure member temperature Tpress. That is, the post-fixing temperature Tpf, which remains at an intended, desirable setpoint Tset of approximately 130° C. with a pressure member temperature Tpress of approximately 60° C., exceeds the intended temperature Tset as the pressure member temperature Tpress rises toward 100° C. and still higher. Thus, the post-fixing temperature Tpf deviates from a desired temperature range even where heating control is provided to the fuser member to maintain a constant heating temperature.

Figure 12A:
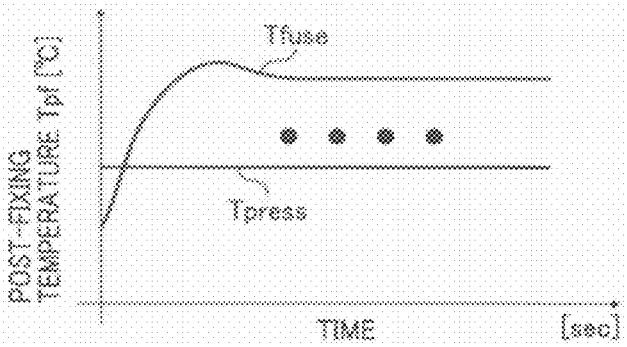
FIGS. 12A and 12B are graphs showing measurements of post-fixing temperature together with operational temperatures of a fuser member and a pressure member, plotted against time in seconds since startup, the former obtained in a fixing device that includes a dedicated heater for each of the pressure and fuser members, and the latter in a fixing device that includes a dedicated heater solely for the fuser member.
Figure 12B:
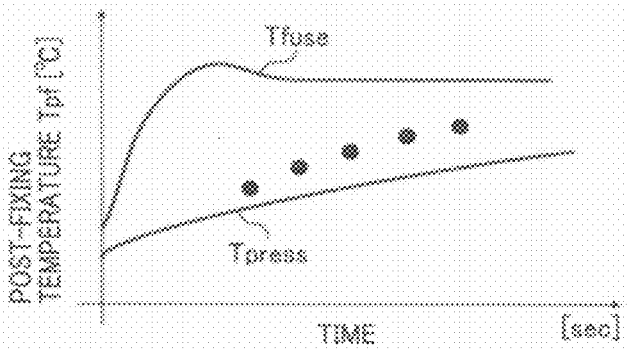

FIGS. 12A and 12B are graphs showing measurements of post-fixing temperature Tpf (denoted by dots) together with operational temperatures of the fuser member and the pressure member, Tfuse and Tpress, respectively, plotted against time in seconds since startup, the former obtained in a fixing device that includes a dedicated heater for each of the pressure and fuser members, and the latter in a fixing device that includes a dedicated heater solely for the fuser member.

As shown in FIG. 12A, the operational temperature Tpress of the pressure member with dedicated heating control remains substantially constant, whereas the operational temperature Tfuse of the fuser member gradually rises upon startup to reach a designed, constant operating temperature. In such cases, the resulting post-fixing temperature Tpf is constant throughout operations. This indicates that, with the fuser and pressure members both exhibiting constant operational temperatures, the amount of heat applied through the fixing nip remains substantially constant to allow for stable performance of the fixing device.

By contrast, as shown in FIG. 12B, the operational temperature Tpress of the pressure member without dedicated heating control gradually changes with time due to accumulated heat, whereas the operational temperature Tfuse of the fuser member gradually rises upon startup to reach a designed, constant operating temperature. In such cases, the resulting post-fixing temperature Tpf varies with the pressure member temperature Tpress. This indicates that the amount of heat applied through the fixing nip varies due to variations in operational temperature of the pressure member even where the fuser member exhibits a constant operational temperature, resulting in inconsistent performance of the fixing device.

Variations in the post-fixing temperature Tpf with the operational temperature Tpress of the pressure member depicted above indicate that the amount of heat applied through the fixing nip N largely depends on the operational temperature Tpress of the pressure member as it does on the operational temperature of the fuser member. Such dependency may be explained by the fact that the recording medium passing through the fixing nip derives heat not only from the fuser member but also, to a certain extent, from the pressure member, so that changes in the pressure member temperature are well reflected in changes in the amount of heat applied through the fixing nip, and thus in the post-fixing temperature.

Inconsistent heating through the fixing nip caused by variations in operational temperature of the pressure member, if not corrected, would cause adverse effects on imaging quality of the fixing process as well as undue energy waste or heating through the fixing nip.

The problem is particularly pronounced in today's energy-efficient systems which have no heater or heating control provided to the pressure member during printing, wherein a heater is designed to selectively heat the fuser member that directly contacts the printed face of a recording medium, while leaving the opposed, pressure member free of excessive accumulated heat, thereby saving energy. In such a fixing device, the pressure member is typically formed of material of a relatively low heat capacity, and therefore is prone to variations in operational temperature due to changes in operational conditions, such as upon entry into a standby or sleep mode, or during sequential processing of multiple recording media.

In particular, the operational temperature of the pressure member tends to vary where the fixing device is employed with different types of recording media, each of which has a specific heat capacity depending on physical and thermal properties of the material, such as thickness, basis weight, density, thermal conductivity, or the like. Using recording media of varying heat capacities can result in a varying operational temperature of the pressure member due to a varying amount of heat dissipated in the recording medium from the pressure member at the fixing nip. Such variations in operational temperature of the pressure member can be significant where the fixing device sequentially processes recording media of a specific type that exhibits a heat capacity different from that originally designed for the fixing process.

Figure 13:
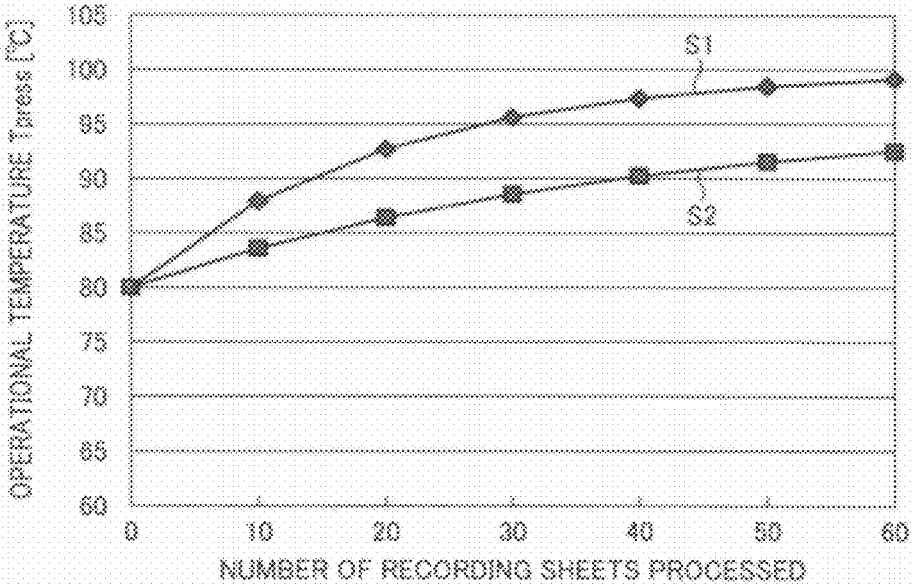
FIG. 13 shows graphs plotting operational temperatures, in degrees Celsius, of a pressure member against a number of recording media sequentially processed during operation in a fixing device.

FIG. 13 shows graphs plotting operational temperatures Tpress, in degrees Celsius, of a pressure member against a number of recording media sequentially processed during operation in a fixing device, wherein the graph labeled "S1" represents values obtained during sequential processing of recording media having a relatively low heat capacity, and the graph labeled "S2" represents values obtained during sequential processing of recording media having a relatively high heat capacity.

As shown in FIG. 13, in general, the operational temperature Tpress of the pressure member gradually increases with the number of recording media processed, as the pressure member accumulates heat from the fuser member heated during operation. Note that the graphs S1 and S2 exhibit different rates of increase, the former being faster than the latter. That is, the increase in operational temperature Tpress is more rapid and significant where the heat capacity of recording media is relatively low than where the heat capacity of recording media is relatively high, since recording media of a lower heat capacity absorbs more heat than do those of a higher heat capacity.

Such difference in the rate of increase in operational temperature Tpress indicates that the operational temperature Tpress of the pressure member varies depending not only on the number of recording media sequentially processed during operation, but also on the type, or more precisely in this case, the heat capacity of recording media being processed.

According to this patent specification, the fixing device 20 can adjust the heating temperature of the fuser member according to an operational temperature of the pressure member detected during operation, so as to process a recording medium with a substantially constant post-fixing temperature regardless of the type of recording medium in use, leading to a consistent and consistently good imaging performance and high energy-efficiency of the fixing process.

Referring back to FIG. 2, the fixing device 20 is shown including a feedback controller 10; a power supply circuit 9 incorporating a pulse-width modulation (PWM) driver connected with the controller 10; a first thermometer 6 being a non-contact sensor disposed adjacent to, and out of contact with, the fuser belt 3 to detect an operational temperature Tfuse of the fuser belt 3 for communication to the controller 10; and a second thermometer 7 disposed adjacent to the pressure roller 2 to detect an operational temperature Tpress of the pressure roller 2 for communication to the controller 10.

Specifically, the feedback controller 10 includes a central processing unit (CPU) that controls overall operation of the apparatus, as well as its associated memory devices, such as a read-only memory (ROM) storing program codes for execution by the CPU and other types of fixed data, a random-access memory (RAM) for temporarily storing data, and a rewritable, non-volatile random-access memory (NVRAM) for storing data during power-off. Such a control system may also include a rotary drive for driving a motor-driven rotary member included in the apparatus, such as a photoconductive drum, a fixing roller, or the like.

The controller 10 incorporates feedback control, or feedback control in conjunction with feed-forward control, for power supply control in the fixing device 20, which serves to control power supply to the heater 5 of the heat roller 4 by controlling the PWM drive circuit 9 to adjust a duty cycle (i.e., the duration per unit of time in which a driving voltage is supplied to the heater 5) according to a differential between a specified setpoint temperature and an operational temperature detected in the fixing device 20, so that the fuser belt 3 heated by the internally heated roller 4 imparts a sufficient amount of heat to the incoming sheet S for fixing the toner image through the fixing nip N.

During operation, a recording sheet S having a specific heat capacity enters the fixing process, absorbing a certain amount of heat from the pressure roller 2 during passage through the fixing nip N. Upon entry of the recording sheet S, the thermometer 7 measures an operational temperature Tpress of the pressure roller 2, and communicates the measured temperature Tpress to the controller 10. The controller 10 receives the measured operational temperature Tpress of the pressure member 2 from the thermometer 7, which reflects the amount of heat dissipated from the pressure roller 2, and thus indicates the heat capacity of the recording sheet S in use.

Based on the measured temperature Tpress, the controller 10 determines an optimal heating temperature Theat to which the fuser belt 3 is to be heated to adjust the post-fixing temperature Tpf to a desired, setpoint temperature Tset for the particular type of recording sheet S being processed. The controller 10 then directs the PWM driver 9 to adjust power supply to the heater 5, so as to heat the fuser belt 3 to the optimized heating temperature Theat, resulting in a substantially constant post-fixing temperature of the recording sheet S at the post-fixing position PF regardless of the heat capacity of the recording sheet S in use.

Optimization of the heating temperature Theat according to the measured operational temperature Tpress may be accomplished, for example, based on a predefined correlation in the form of a lookup table or mathematical formula stored in an appropriate memory such as ROM or the like, which associates a specific operational temperature of the pressure roller 2 with an optimal heating temperature Theat for maintaining the post-fixing temperature Tpf at a desired setpoint temperature Tset. Such correlation may be determined theoretically through calculation, or empirically from raw data obtained through experimentation.

Additionally, the operational temperature Tfuse of the fuser belt 3 detected by the first thermometer 6 may also be involved as input variables in the control of the heating temperature Theat, in which case the controller 10 manipulates the heating temperature Theat based on the multiple input temperatures to obtain the desired post-fixing temperature Tpf.

Figure 14:
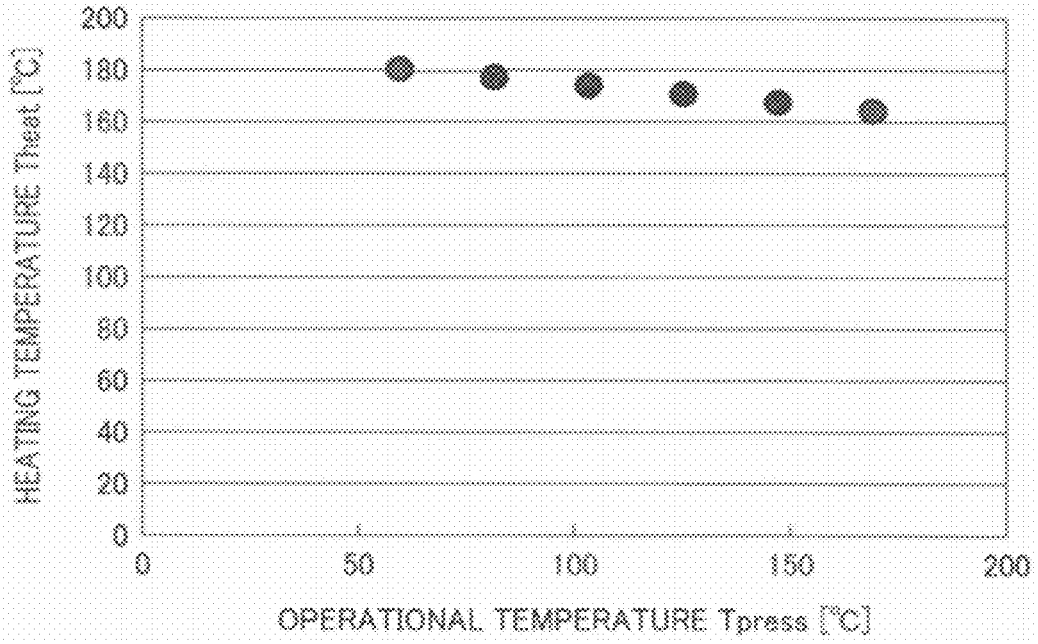
FIG. 14 is a graph showing an example of correlation between an optimal heating temperature and an operational temperature of a pressure roller in the fixing device of FIG. 2.

FIG. 14 is a graph showing an example of correlation between the optimal heating temperature Theat and the operational temperature Tpress of the pressure roller 2, where the post-fixing temperature Tpf is maintained at a setpoint temperature Tset of 130° C.

As shown in FIG. 14, the correlation between the optimal heating temperature Theat and the operational temperature Tpress in this case may be approximately expressed by a linear function. Substituting a specific, detected operational temperature Tpress of the pressure roller 2 into such a linear correlation function yields a specific heating temperature Theat required to maintain the post-fixing temperature Tpf at the desired setpoint temperature Tset.

In feedback heating control according to this patent specification, the post-fixing temperature of a recording sheet S may be determined through simulation of thermal conduction among fixing members at the fixing nip N. An example of such is illustrated below with reference to FIG. 15, which is an enlarged, partial view of the fixing device 20 shown with a recording sheet S passing through the fixing nip N in the conveyance direction X.

Figure 15:
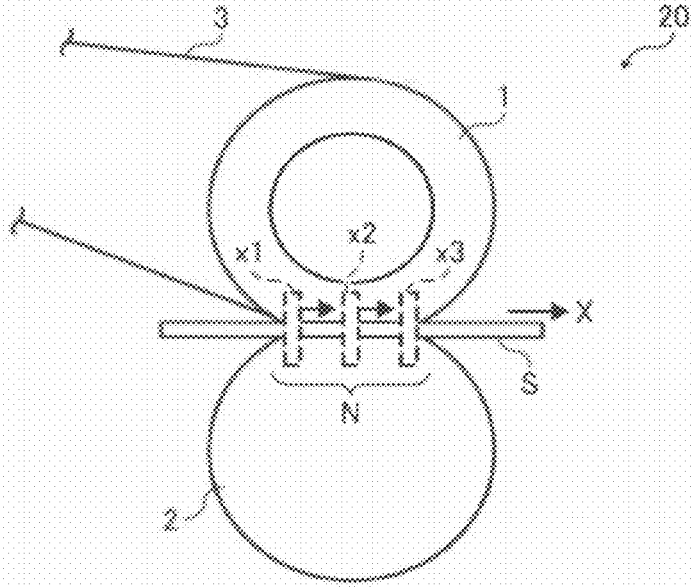
FIG. 15 is an enlarged, partial view of the fixing device shown with a recording sheet passing through the fixing nip in the conveyance direction.

As shown in FIG. 15, the recording sheet S reaches firstly an upstream end point x1, then an intermediate point x2, and finally a downstream end point x3 during passage through the fixing nip N, while absorbing heat from the fixing members, each of which has particular physical properties, including density, thermal conductivity, and specific heat capacity. Variations in the post-fixing temperature Tpf experienced by the recording sheet S due to conduction of heat from the fixing member is obtained by solving the following heat conduction equation:

$$\rho c\frac{\partial\theta}{\partial t} = \frac{\partial}{\partial x}\left(\lambda\frac{\partial\theta}{\partial x}\right) + \frac{\partial}{\partial y}\left(\lambda\frac{\partial\theta}{\partial y}\right) \quad \text{Eq. 1}$$

where "θ" represents temperature, "ρ" represents density, "c" represents specific heat capacity, "λ" represents thermal conductivity of the fixing member, and "t" represents time.

The equation Eq. 1 above may be used to simulate thermal conduction among adjoining members, including the fuser member, the pressure member, and the recording medium, during fixing process, wherein temperature distribution at the upstream end point x1 is given as an initial condition, based on which the amount of heat applied at the intermediate point x2 and the downstream end point x3, respectively, are determined. For simplicity of calculation, the nonlinear original function Eq. 1 may be transformed into a finite difference equation to obtain an approximated numerical solution, of which a detailed description is omitted herein.

Figure 16:
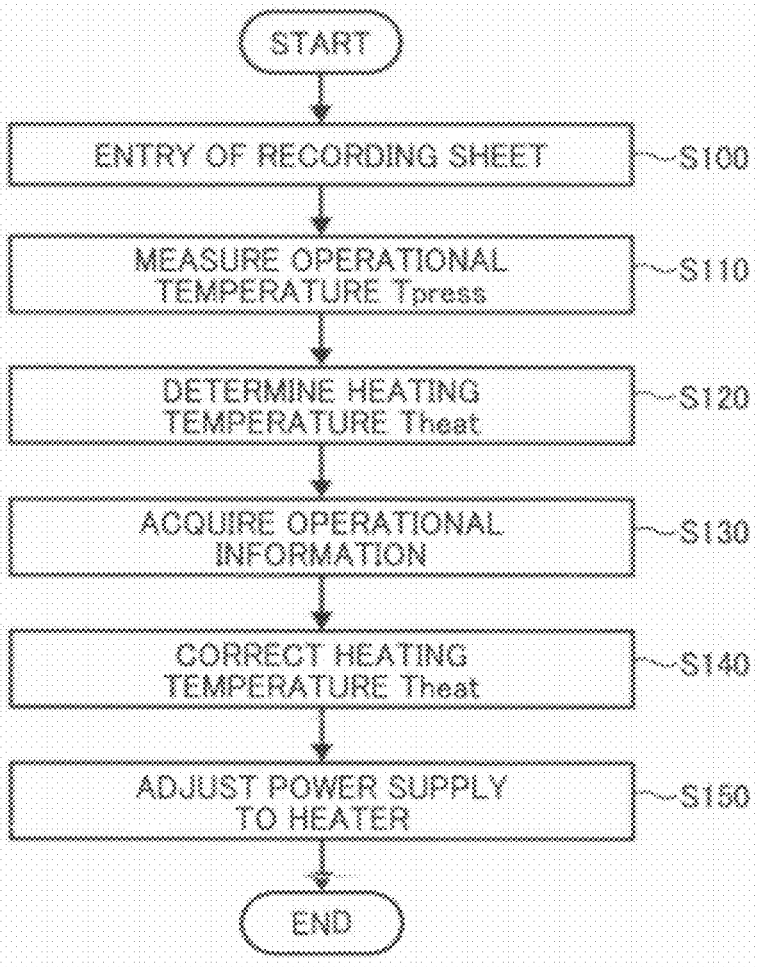
FIG. 16 is a flowchart illustrating feedback heating control performed by the fixing device of FIG. 2.

FIG. 16 is a flowchart illustrating feedback heating control performed by the fixing device 20 according to one embodiment of this patent specification.

As shown in FIG. 16, the fixing device 20 initiates feedback heating control as a recording sheet S enters the fixing process, absorbing a certain amount of heat from the pressure roller 2 during passage through the fixing nip N (step S100).

Initially, the thermometer 7 measures an operational temperature Tpress of the pressure roller 2 during passage through the fixing nip N, and communicates the measured temperature Tpress to the controller 10 (step S110). Based on the operational temperature Tpress, which reflects the amount of heat dissipated from the pressure roller 2, and thus indicates the heat capacity of the recording sheet S in use, the controller 10 determines an optimal heating temperature Theat to which the fuser belt 3 is to be heated to adjust the post-fixing temperature Tpf to a desired, setpoint temperature Tset for the particular type of recording sheet S being processed (step S120).

Optionally, the controller 10 may acquire one or more operational parameters such as physical properties of the recording sheet S in use, including nip dwell time, basis weight, thermal conductivity, specific heat capacity, moisture content, and any combination thereof, which may be obtained through measurement with a sensor, or derived from user-specified information stored in an appropriate memory (step S130), so as to accordingly correct the heating temperature Theat based on the acquired information of the recording sheet S (step S240). Such correction to the heating temperature Theat may be accomplished, for example, by modifying the predefined correlation between the optimal heating temperature Theat and the operational temperature Tpress, as will be described later in more detail.

With the heating temperature Theat thus determined, the controller 10 then directs the PWM driver 9 to adjust power supply to the heater 5, so as to heat the fuser belt 3 to the optimized heating temperature Theat, resulting in a substantially constant post-fixing temperature of the recording sheet S at the post-fixing position PF regardless of the heat capacity of the recording sheet S in use (step S150).

The feedback heating control described in steps S110 through S150 may be performed repeatedly or continuously during processing of a single print job, and terminate upon completion of fixing on the recording sheet S through the fixing nip N.

Figure 17:
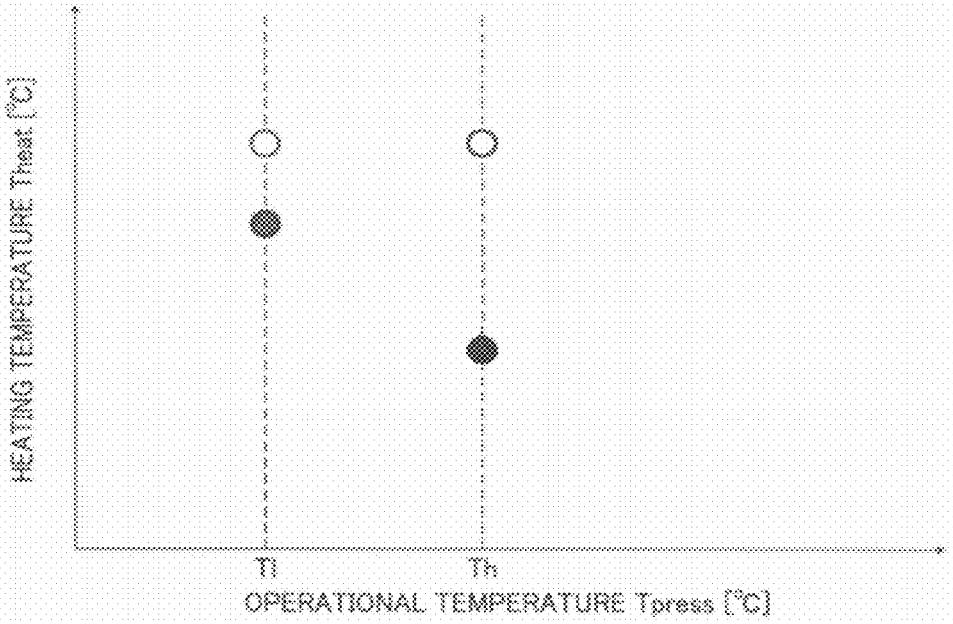
FIG. 17 shows graphs plotting the heating temperature against the operational temperature of a pressure member, both in degrees Celsius, measured after sequential processing of recording media of a relatively low heat capacity causing a low operational temperature, and after sequential processing of recording media of a relatively high heat capacity causing a high operational temperature.

FIG. 17 shows graphs plotting the heating temperature Theat against the operational temperature Tpress of a pressure member, both in degrees Celsius, measured after sequential processing of recording media of a relatively low heat capacity causing a low operational temperature T1, and after sequential processing of recording media of a relatively high heat capacity causing a high operational temperature Th, wherein black dots represent values obtained where the heating temperature Theat is feedback-controlled according to the operational temperature Theat, and white dots represents values obtained where the heating temperature Theat is controlled to maintain to a constant operational temperature of the fuser member.

As shown in FIG. 17, the feedback control of the heating temperature Theat according to the operational temperature Tpress causes the heating temperature Theat to decrease as the operational temperature Tpress increases upon sequential processing of recording media with different heat capacities, so that the heating temperature Theat is relatively high with the relatively low operational temperature T1, and relatively low with the relatively high operational temperature Th. By contrast, without such feedback heating control, the heating temperature Theat is maintained substantially constant irrespective of the operational temperature Tpress varying upon sequential processing of recording media with different heat capacities.

Figure 18:
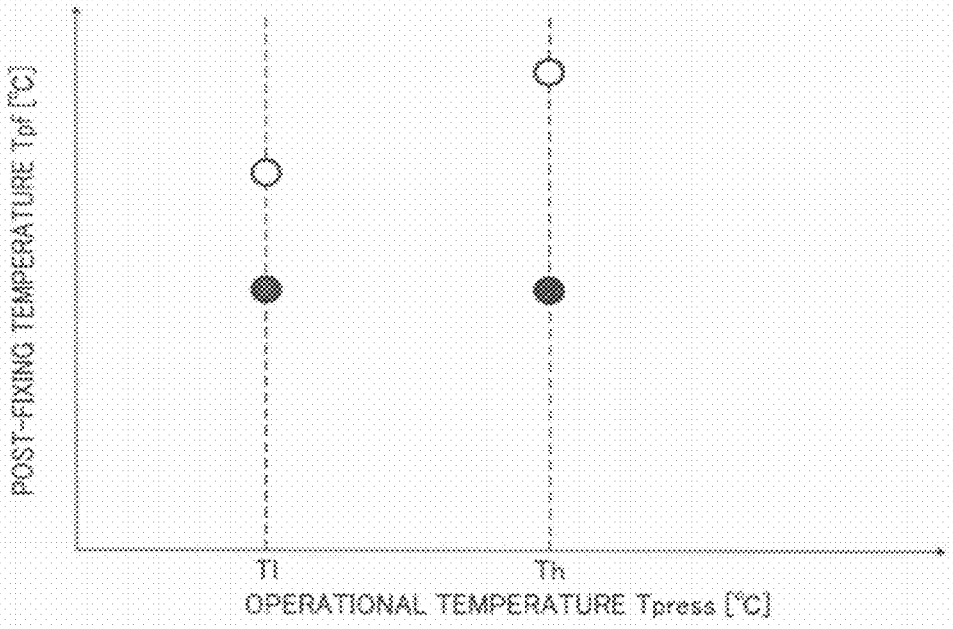
FIG. 18 shows graphs plotting the post-fixing temperature against the operational temperature of the pressure member, both in degrees Celsius, measured after sequential processing of recording media of a relatively low heat capacity causing a low operational temperature, and after sequential processing of recording media of a relatively high heat capacity causing a high operational temperature.

FIG. 18 shows graphs plotting the post-fixing temperature Tpf against the operational temperature Tpress of the pressure member, both in degrees Celsius, measured after sequential processing of recording media of a relatively low heat capacity causing a low operational temperature T1, and after sequential processing of recording media of a relatively high heat capacity causing a high operational temperature Th, wherein black dots represent values obtained where the heating temperature Theat is feedback-controlled according to the operational temperature Theat, and white dots represents values obtained where the heating temperature Theat is controlled to maintain to a constant operational temperature of the fuser member.

As shown in FIG. 18, the feedback control of the heating temperature Theat according to the operational temperature Tpress of the pressure member maintains the post-fixing temperature Tpf at a constant level irrespective of the operational temperature Tpress varying due to sequential processing of recording media with different heat capacities. By contrast, without such feedback heating control, the post-fixing temperature Tpf varies with the operational temperature Tpress upon sequential processing of recording media with different heat capacities.

The graphs of FIGS. 17 and 18 indicate that compared to a conventional heating control that maintains a constant operational temperature of the fuser member, the feedback control according to this patent specification allows for energy-efficient thermal fixing process, wherein controlling the heating temperature Theat according to the operational temperature Tpress prevents excessive heat and power consumed during processing of recording media of lower heat capacities, while maintaining sufficient heat to be supplied during processing of recording media of higher heat capacities.

Also indicated is that the feedback heating control according to this patent specification can process different types of recording media with a consistent and consistently high imaging quality of the fixing process, wherein controlling the heating temperature Theat according to the operational temperature Tpress reflecting the amount of heat dissipated from the pressure member in the recording medium results in a substantially constant post-fixing temperature Tpf of the recording medium regardless of the heat capacity of each specific type of recording medium.

Hence, the fixing device 20 according to this patent specification can process a recording sheet S with consistent and consistently good imaging quality and high thermal efficiency, wherein the controller 10, operatively connected with the thermometer 7 disposed outside the fixing nip N to measure an operational temperature Tpress of the pressure roller 2 indicative of a heat capacity of a recording medium S in use, optimizes a heating temperature Theat to which the fuser belt 3 is heated according to the detected temperature Tpress for the specific type of recording sheet S being processed, so that the recording sheet S exhibits a substantially constant post-fixing temperature Tpf downstream from the fixing nip N regardless of the heat capacity of the recording sheet S in use.

In particular, the fixing device 20 can perform feedback heating control based on an operational temperature of the pressure member detected outside the fixing nip N, instead of a measured post-fixing temperature of the recording medium. Feedback heating control based on the detected operational temperature of the pressure member is less costly to implement, while allowing for good control with a fast and reliable response to changes in the post-fixing temperature, compared to feedback control involving measurement of post-fixing temperature with a relatively expensive, laser-based thermometer.

Also, the fixing device 20 can control heating through the fixing nip N by adjusting the heating temperature Theat of the fuser belt 3 according to the operational temperature Tpress of the pressure roller 2. Compared to heating control through adjustment of the nip dwell time, heating control through adjustment of the heating temperature Theat is superior in terms of responsiveness and controllability to obtain a desired, constant post-fixing temperature regardless of the heat capacity of recording sheet S in use.

According to one or more embodiments of this patent specification, the controller 10 performs feedback heating control so as to maintain the post-fixing temperature at an adjustable, setpoint temperature Tset. The setpoint temperature Tset may fall in a range from approximately 120° C. to approximately 140° C., and preferably, from approximately 125° C. to approximately 135° C. The controller can perform feedback heating control to maintain the post-fixing temperature within 5° C. from the setpoint temperature Tset.

Specifically, the fixing device 20 maintains the post-fixing temperature Tpf within an optimal range of approximately 5° C., resulting in a consistent imaging quality with uniform gloss of the resulting prints. Such optimal range is consistently attained where the fixing device 20 processes different sets of ten recording sheets sequentially through the fixing nip N, each sheet set being made of paper material with a basis weight ranging from 55 g/m$^2$ to 100 g/m$^2$ as is frequently used in a typical office environment.

Experiment III

Experiments have been conducted to evaluate criticality of having the 5-degree optimal range for variations in the post-fixing temperature Tpf in terms of its effects on imaging quality dictated by image glossiness.

In the experiments, three pairs of sample images were prepared employing a fixing device that incorporated a fuser member having its circumferential surface formed of PFA. Before printing, the fuser member was heated to a specified temperature, and then was left idle for approximately 15 minutes to allow the entire assembly to accumulate sufficient heat therein. Printing was conducted using a recording media of enamel paper, weighing 180 g/m$^2$, and polyester polymerization black toner, under an ambient temperature of 23° C., with a nip dwell time of 45 msec.

Each pair of sample images prepared included a reference image having a standard level of gloss and a comparative image having another level of gloss, so that there was a difference in gloss between the reference and comparative image samples: Sample A with a gloss difference of 5%; Sample B with a gloss difference of 7.5%; and Sample C with a gloss difference of 10%. The glossiness of each image sample was determined by a commercially available, specular glossmeter, model Uni Gloss 60 manufactured by Konica Minolta Sensing, Inc., which measures specular reflection of light illuminating a surface at an incident angle of 60°, as is typically applied in measuring glossiness of printed materials, such as those for office use.

The sample images were presented side by side to human evaluators, who were then asked whether there was any difference in appearance between the standard and comparative image samples. Perceptibility of gloss difference was determined as a percentage of evaluators who answered that they perceived a difference in gloss between the paired images, so that the gloss difference detracted from the appearance or visual quality of the image sample.

Figure 19:
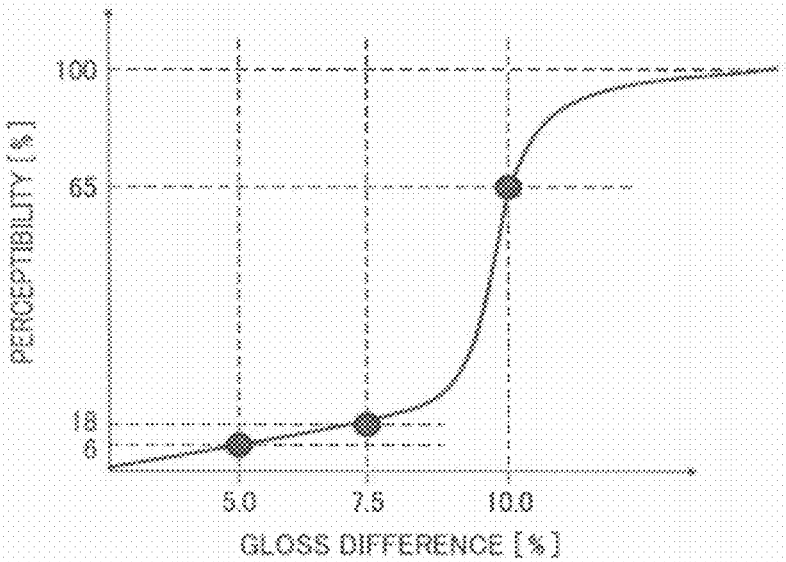
FIG. 19 is a graph showing experimental results, in which the perceptibility of gloss difference is plotted against the level of gloss difference in % between paired sample images.

FIG. 19 is a graph showing the results of Experiment III, in which the perceptibility of gloss difference is plotted against the level of gloss difference in % between the paired sample images.

As shown in FIG. 19, the perceptibility of gloss difference is approximately 6% for the gloss difference of 5% (Sample A), approximately 18% for the gloss difference of 7.5% (Sample B), and approximately 65% for the gloss difference of 10% (Sample C). In particular, there is a sharp increase in the perceptibility of gloss difference as the gloss difference exceeds a threshold level of approximately 7.5%.

The experimental results indicate that a gloss difference of 5% or 7.5% across a single image is substantially imperceptible to human eyes, whereas a gloss difference of 10% across a single image is noticeable and can significantly detract from the image quality. Considering the threshold level for perceptibility of gloss difference, keeping the gloss difference within 7.5% can ensure good imaging quality of the fixing device in terms of uniformity in gloss across an image.

With additional reference to FIG. 10, as mentioned earlier, the image glossiness generally increases as the post-fixing temperature Tpf increases, yielding a strong linear correlation between the image glossiness and the post-fixing temperature, so that a change of 5 degrees in post-fixing temperature is accompanied with a change of 7.5% in image glossiness. In such cases, keeping variations in post-fixing temperature within a range of 5 degrees allows the fixing device 20 to produce a printed image with a gloss difference falling within the threshold level of approximately 7.5%.

Figure 20:
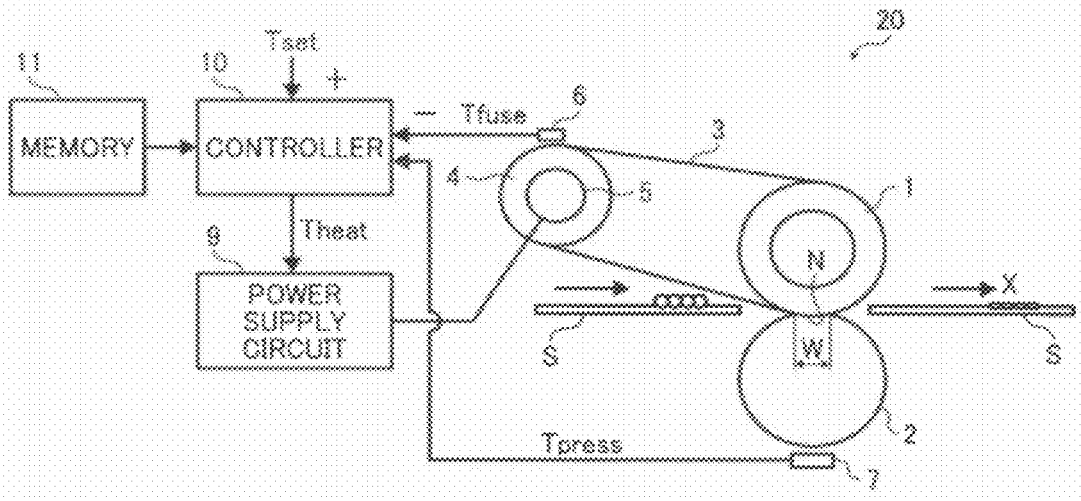
FIG. 20 is an end-on, axial cutaway view schematically illustrating the fixing device according to a further embodiment of this patent specification.

FIG. 20 is an end-on, axial cutaway view schematically illustrating the fixing device 20 according to a further embodiment of this patent specification.

As shown in FIG. 20, the overall configuration of the present embodiment is similar to that depicted in FIG. 2, except that the fixing device 20 further includes a memory 11 operatively connected to the controller 10, which contains the type of recording sheet S in use as specified by a user through a user interface such as a control panel of the image forming apparatus, or through a personal computer connected to the apparatus via network.

In such a configuration, the controller 10 may access to the memory 11 to acquire one or more operational parameters such as physical properties of a recording sheet S to accordingly correct the amount of heat applied through the fixing nip N based on the acquired information of the recording sheet S. Such operational parameters include, for example, a nip dwell time t which changes as the width w of fixing nip changes due to thermal expansion or contraction of the fixing members accumulating heat during operation, as well as basis weight w, thermal conductivity λ, specific heat capacity c, and moisture content θ of a recording sheet in use, each of which may be obtained through measurement with a sensor, or derived from user-specified information stored in an appropriate memory.

Such arrangement enables the controller 10 to properly determine an optimal heating temperature Theat based on a measured operational temperature Tpress of the pressure member 2, even where the amount of heat applied through the fixing nip N changes as variations in operational parameters affect conduction of heat from the pressure member across the fixing nip N. Several such embodiments are depicted hereinbelow with reference to FIG. 21 and subsequent drawings.

Figure 21:
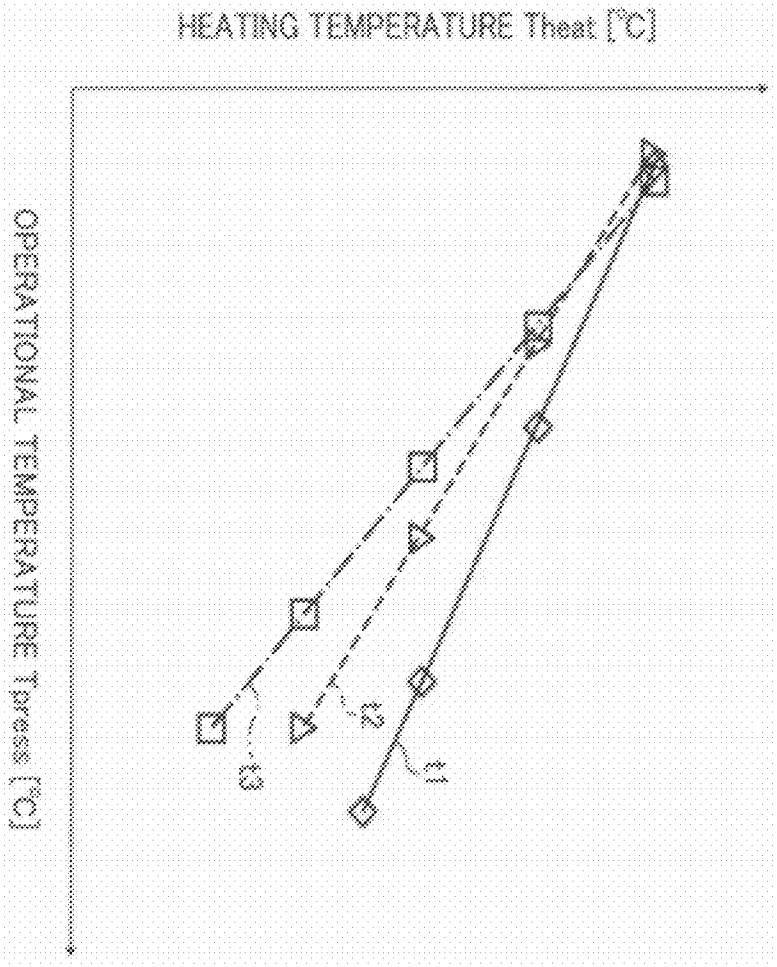
FIG. 21 shows graphs of optimal heating temperatures in degrees Celsius required to maintain a constant post-fixing temperature, plotted against the operational temperature in degrees Celsius of the pressure roller in the fixing device.

FIG. 21 shows graphs of optimal heating temperatures Theat in degrees Celsius required to maintain a constant post-fixing temperature Tpf, plotted against the operational temperature Tpress in degrees Celsius of the pressure roller 2, wherein a solid line labeled "t1" represents values obtained with a nip dwell time of 30 msec, a broken line labeled "t2" represents values obtained with a nip dwell time of 50 msec, and a dash-dotted line labeled "t3" represents values obtained with a nip dwell time of 100 msec, each value being measured using a recording medium of a basis weight of 70 g/m$^2$, a thermal conductivity of 0.16 W/(m*K), a specific heat capacity of 1,012 kJ/(m$^3$*K), an initial, pre-fixing temperature of 23° C., and a moisture content of 4%.

As shown in FIG. 21, the optimal heating temperature Theat linearly decreases as the operational temperature Tpress of the pressure roller 2 increases. The linear relation between the temperatures Theat and Tpress is generally defined by the following correlation equation:

$$Theat=m*Tpress+b \quad \text{Eq. 2}$$

where "m" and "b" are the slope and the y-intercept, respectively, of the linear function. Note that the lines t1 through t3 represent linear functions having different negative slopes m and different y-intercepts b, indicating dependency of these constants on the nip dwell time t of a recording sheet S. In particular, the slope m of the linear function, in absolute value, is largest for the nip dwell time of 100 msec and smallest for the nip dwell time of 30 msec.

Figure 22A:
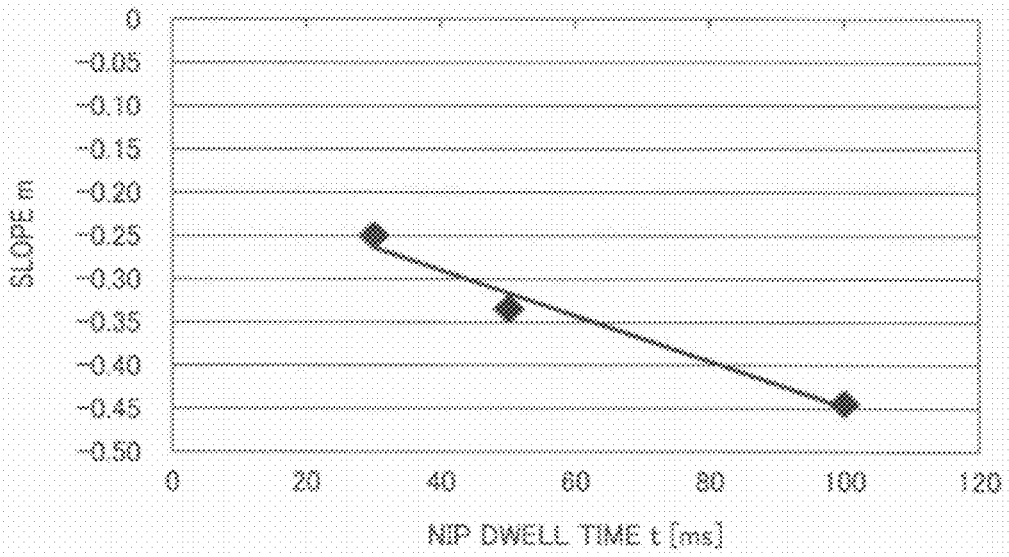
FIGS. 22A and 22B are graphs deduced from a linear function represented by the graphs of FIG. 21, the former showing a relation between the slope of the linear function and nip dwell time in milliseconds, and the latter showing a relation between the y-intercept of the linear function and nip dwell time in milliseconds.

FIG. 22A is a graph showing a relation between the slope m of the linear function Eq. 2 and the nip dwell time t in milliseconds, as deduced from the graphs of FIG. 21.

As shown in 22A, the absolute value of the slope m linearly increases with increasing nip dwell time t. In the present example, the relation between the variables m and t is represented by the following approximate equation:

$$m=m(t)=-0.0027*t-0.1812 \quad \text{Eq. 3}$$

Since the magnitude of slope m represents a degree to which the heating temperature Theat depends on the operational temperature Tpress of the pressure roller 2, the equation Eq. 3 above indicates that the longer the nip dwell time t, the greater the effect of the pressure roller temperature Tpress on the heating temperature Theat, and the resulting post-fixing temperature Tpf. Such a relation between the nip dwell time t and the effect of the pressure roller temperature Tpress is attributable to the fact that a prolonged nip dwell time t results in a greater amount of heat conducted from the pressure roller 2 to the recording sheet S through the fixing nip N.

Figure 22B:
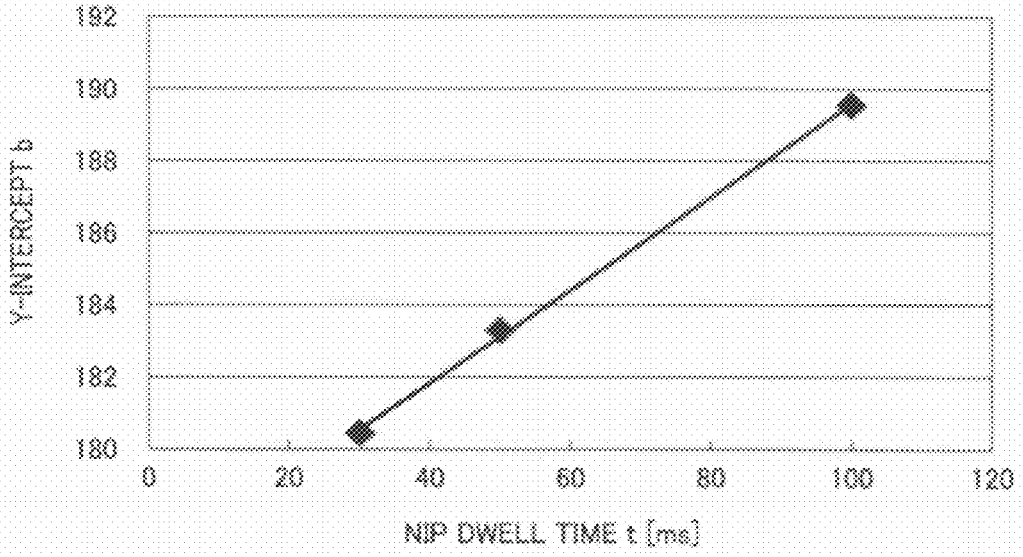

FIG. 22B is a graph showing a relation between the y-intercept b of the linear function Eq. 2 and the nip dwell time t in milliseconds, as deduced from the graphs of FIG. 21.

As shown in FIG. 22B, the y-intercept b linearly increases with increasing nip dwell time t. In the present example, the relation between the variables b and t is represented by the following approximate equation:

$$b=b(t)=0.1282*t+176.7 \quad \text{Eq. 4}$$

Thus, the slope and the y-intercept of the linear function Eq. 2 can be represented by the t-dependent functions m(t) and b(t), respectively, the value of each of which is determined by the nip dwell time t of a recording sheet S.

In the feedback heating control according to this patent specification, specific t-dependent functions m(t) and b(t), or coefficients of these equations, determined experimentally or through simulation are stored in the memory for later retrieval. Specific values of nip dwell time t may be derived, for example, through estimation from thermal conditions of the fixing members expanding or contracting with varying operational temperatures or through measurement using an appropriate sensor. Substituting a nip dwell time t into the functions m(t) and b(t) gives specific values of m and b, which in turn are substituted into the equation Eq. 2 to yield a correlation between the temperatures Theat and Tpress modified for the specific nip dwell time t, as follows:

$$Theat=m(t)*Tpress+b(t) \quad \text{Eq. 2.1}$$

Applying the equation Eq. 2.1 above gives a corrected optimal heating temperature Theat for a specific nip dwell time t with which a recording sheet S in use is processed through the fixing nip N. Such modification to the correlation between the optimal heating temperature Theat and the operational temperature Tpress based on the nip dwell time t allows for adjusting the amount of heat applied through the fixing nip N as the fixing device 20 processes different recording sheets S with different nip dwell times t, resulting in an effective feedback heating control to maintain a constant post-fixing temperature regardless of changes in the operational conditions.

Figure 23:
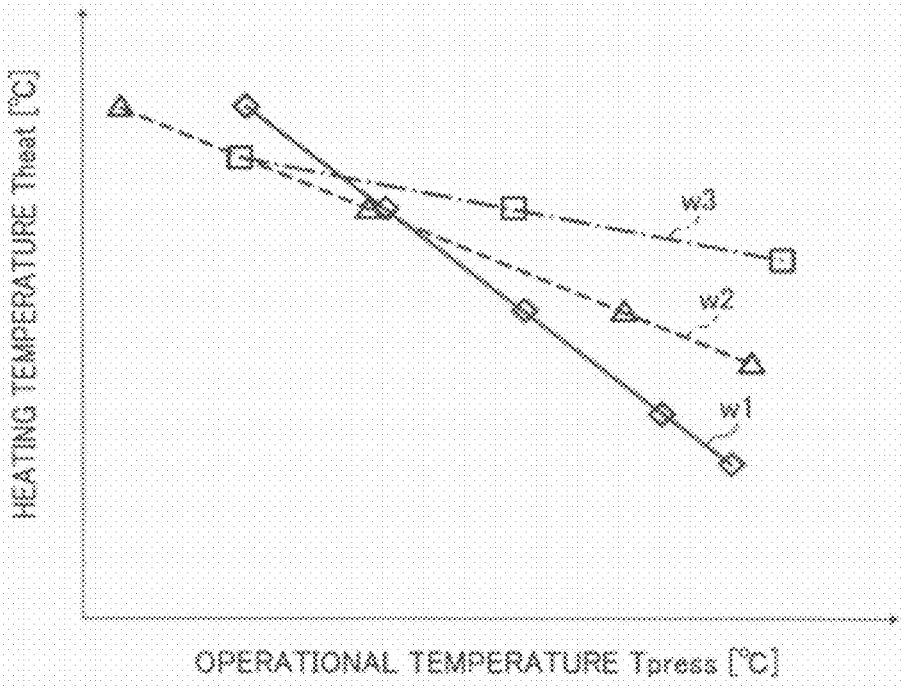
FIG. 23 shows graphs of optimal heating temperatures in degrees Celsius required to maintain a constant post-fixing temperature, plotted against the operational temperature in degrees Celsius of the pressure roller in the fixing device.

FIG. 23 shows graphs of optimal heating temperatures Theat in degrees Celsius required to maintain a constant post-fixing temperature Tpf, plotted against the operational temperature Tpress in degrees Celsius of the pressure roller 2, wherein a solid line labeled "w1" represents values obtained with a basis weight of 54 g/m$^2$, a broken line labeled "w2" represents values obtained with a basis weight of 100 g/m$^2$, and a dash-dotted line labeled "w3" represents values obtained with a basis weight of 150 g/m$^2$, each value being measured with a nip time of 50 msec, using a recording medium of a thermal conductivity of 0.16 W/(m*K), a specific heat capacity of 1,012 kJ/(m$^3$*K), an initial, pre-fixing temperature of 23° C., and a moisture content of 4%.

As shown in FIG. 23, the heating temperature Theat linearly decreases as the operational temperature Tpress of the pressure roller 2 increases, as is generally defined by a linear function presented earlier as Eq. 2.

Note that, as is the case with the lines t1 through t3 of FIG. 21, the lines w1 through w3 represent linear functions having different negative slopes m and different y-intercepts b, indicating dependency of these constants on the basis weight w of a recording sheet S.

In particular, the magnitude of slope m of the linear function Eq. 2 is negatively associated with the basis weight w, wherein the slope m of the linear function, in absolute value, is largest for the basis weight of 54 g/m$^2$ and smallest for the basis weight of 150 g/m$^2$, which indicates that the smaller the basis weight w, the greater the effect of the pressure roller temperature Tpress on the heating temperature Theat, and the resulting post-fixing temperature Tpf. Such a relation between the basis weight w and the effect of the pressure roller temperature Tpress is attributable to the fact that a reduced basis weight w of recording sheet results in accelerated conduction of heat from the pressure roller 2 to the recording sheet S through the fixing nip N.

Thus, the slope and the y-intercept of the linear function Eq. 2 can be represented by w-dependent functions m(w) and b(w), respectively, the value of each of which is determined by the basis weigh w of a recording sheet S.

In the feedback heating control according to this patent specification, specific w-dependent functions m(w) and b(w), or coefficients of these equations, determined experimentally or through simulation are stored in the memory for later retrieval. Specific values of basis weight w may be derived, for example, from user-specified information or through measurement using an appropriate sensor. Substituting a basis weight w into these functions m(w) and b(w) gives specific values of m and b, which in turn are substituted into the equation Eq. 2 to yield a correlation between the temperatures Theat and Tpress modified for the specific basis weight w, as follows:

$$Theat=m(w)*Tpress+b(w) \quad \text{Eq. 2.2}$$

Applying the equation Eq. 2.2 above gives a corrected heating temperature Theat for a specific basis weight w of a recording sheet S in use. Such modification to the correlation between the optimal heating temperature Theat and the operational temperature Tpress based on the basis weigh w allows for adjusting the amount of heat applied through the fixing nip N as the fixing device 20 processes different recording sheets S of different basis weights w, resulting in an effective feedback heating control to maintain a constant post-fixing temperature regardless of changes in the operational conditions.

Figure 24:
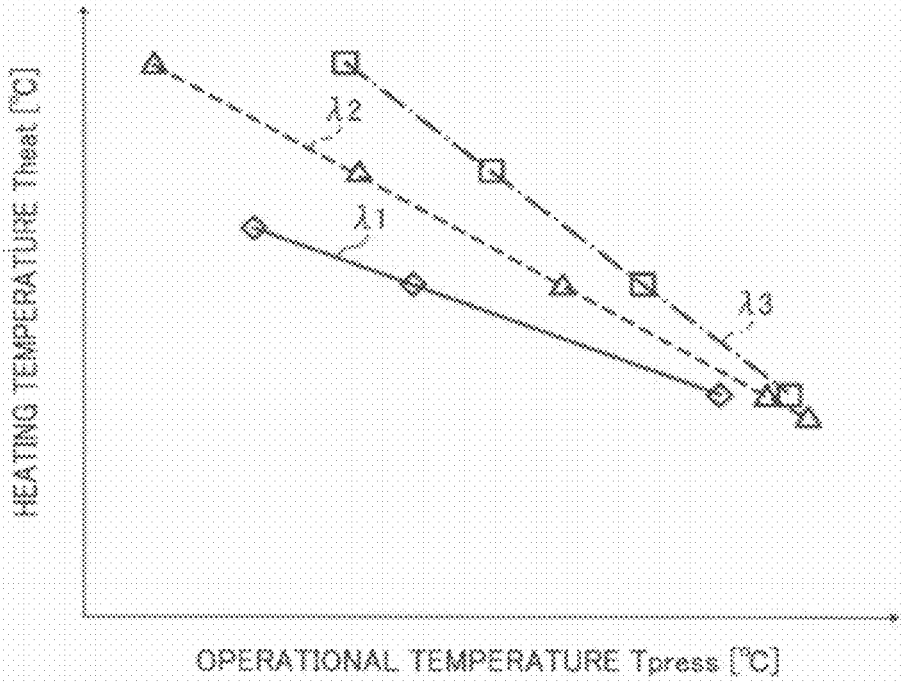
FIG. 24 shows graphs of optimal heating temperatures in degrees Celsius required to maintain a constant post-fixing temperature, plotted against the operational temperature in degrees Celsius of the pressure roller in the fixing device.

FIG. 24 shows graphs of optimal heating temperatures Theat in degrees Celsius required to maintain a constant post-fixing temperature Tpf, plotted against the operational temperature Tpress in degrees Celsius of the pressure roller 2, wherein a solid line labeled "λ1" represents values obtained with a thermal conductivity of 0.1 W/(m*K), a broken line labeled "λ2" represents values obtained with a thermal conductivity of 0.16 W/(m*K), and a dash-dotted line labeled "λ3" represents values obtained with a thermal conductivity of 0.25 W/(m*K), each value being measured with a nip time of 50 msec, using a recording medium of a basis weight of 70 g/m$^2$, a specific heat capacity of 1,012 kJ/(m$^3$*K), an initial, pre-fixing temperature of 23° C., and a moisture content of 4%.

As shown in FIG. 24, the heating temperature Theat linearly decreases as the operational temperature Tpress of the pressure roller 2 increases, as is generally defined by a linear function presented earlier as the equation Eq. 2.

Note that, as is the case with the lines t1 through t3 of FIG. 21, the lines λ1 through λ3 represent linear functions having different negative slopes m and different y-intercepts b, indicating dependency of these constants on the thermal conductivity λ of a recording sheet S.

In particular, the magnitude of slope m of the linear function Eq. 2 is positively associated with the thermal conductivity λ, wherein the slope m of the linear function, in absolute value, is largest for the thermal conductivity of 0.25 W/(m*K) and smallest for the thermal conductivity of 0.1 W/(m*K), which indicates that the greater the thermal conductivity λ, the greater the effect of the pressure roller temperature Tpress on the heating temperature Theat, and the resulting post-fixing temperature Tpf. Such a relation between the thermal conductivity λ and the effect of the pressure roller temperature Tpress is attributable to the fact that an increased thermal conductivity λ of recording sheet results in accelerated conduction of heat from the pressure roller 2 to the recording sheet S through the fixing nip N.

Thus, the slope and the y-intercept of the linear function Eq. 2 can be represented by λ-dependent functions m(λ) and b(λ), respectively, the value of each of which is determined by the thermal conductivity λ of a recording sheet S.

In the feedback heating control according to this patent specification, specific λL-dependent functions m(λ) and b(λ), or coefficients of these equations, determined experimentally or through simulation are stored in the memory for later retrieval. Specific values of thermal conductivity λ may be derived, for example, from user-specified information or through measurement using an appropriate sensor. Substituting a thermal conductivity λ, into these functions m(λ) and b(λ) gives specific values of m and b, which in turn are substituted into the equation Eq. 2 to yield a correlation between the temperatures Theat and Tpress modified for the specific thermal conductivity λ, as follows:

$$Theat=m(k)*Tpress+b(X) \quad \text{Eq. 2.3}$$

Applying the equation Eq. 2.3 above gives a corrected heating temperature Theat for a specific thermal conductivity λ of a recording sheet S in use. Such modification to the correlation between the optimal heating temperature Theat and the operational temperature Tpress based on the thermal conductivity λ allows for adjusting the amount of heat applied through the fixing nip N as the fixing device 20 processes different recording sheets S of different thermal conductivities λ, resulting in an effective feedback heating control to maintain a constant post-fixing temperature regardless of changes in the operational conditions.

Figure 25:
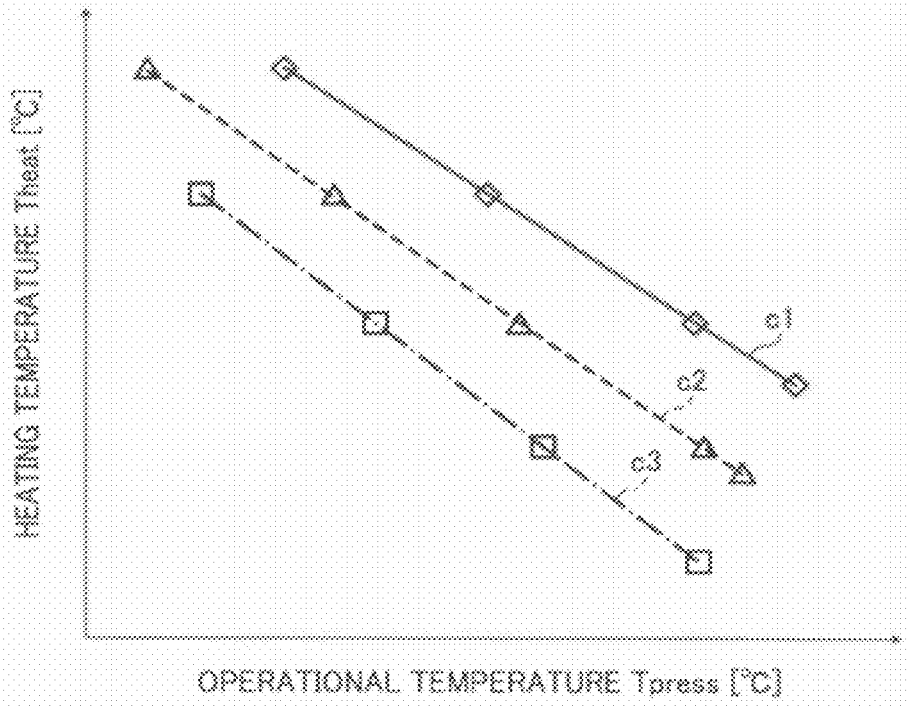
FIG. 25 shows graphs of optimal heating temperatures in degrees Celsius required to maintain a constant post-fixing temperature, plotted against the operational temperature in degrees Celsius of the pressure roller in the fixing device.

FIG. 25 shows graphs of optimal heating temperatures Theat in degrees Celsius required to maintain a constant post-fixing temperature Tpf, plotted against the operational temperature Tpress in degrees Celsius of the pressure roller 2, wherein a solid line labeled "c1" represents values obtained with a specific heat capacity of 1,440 kJ($m^3$*K), a broken line labeled "c2" represents values obtained with a specific heat capacity of 1,012 kJ/($m^3$*K), and a dash-dotted line labeled "c3" represents values obtained with a specific heat capacity of 760 kJ/($m^3$*K), each value being measured with a nip time of 50 msec, using a recording medium of a basis weight of 70 g/$m^2$, a thermal conductivity of 0.16 W/(m*K), an initial, pre-fixing temperature of 23° C., and a moisture content of 4%.

As shown in FIG. 25, the heating temperature Theat linearly decreases as the operational temperature Tpress of the pressure roller 2 increases, as is generally defined by a linear function presented earlier as the equation Eq. 2.

Note that, as is the case with the lines t1 through t3 of FIG. 21, the lines c1 through c3 represent linear functions having different negative slopes m and different y-intercepts b, indicating dependency of these constants on the specific heat capacity c of a recording sheet S.

In particular, the magnitude of slope m of the linear function Eq. 2 is negatively, if slightly, associated with the specific heat capacity c, wherein the slope m of the linear function, in absolute value, is largest for the specific heat capacity of 760 kJ($m^3$*K) and smallest for the specific heat capacity of 1,440 kJ($m^3$*K), which indicates that the smaller the specific heat capacity c, the greater the effect of the pressure roller temperature Tpress on the heating temperature Theat, and the resulting post-fixing temperature Tpf. Such a relation between the specific heat capacity c and the effect of the pressure roller temperature Tpress is attributable to the fact that a reduced specific heat capacity c of recording sheet results in accelerated conduction of heat from the pressure roller 2 to the recording sheet S through the fixing nip N.

Thus, the slope and the y-intercept of the linear function Eq. 2 can be represented by c-dependent functions m(c) and b(c), respectively, the value of each of which is determined by the specific heat capacity c of a recording sheet S.

In the feedback heating control according to this patent specification, specific c-dependent functions m(c) and b(c), or coefficients of these equations, determined experimentally or through simulation are stored in the memory for later retrieval. Specific values of heat capacity c may be derived, for example, from user-specified information or through measurement using an appropriate sensor. Substituting a specific heat capacity c into these functions m(c) and b(c) gives specific values of m and b, which in turn are substituted into the equation Eq. 2 to yield a correlation between the temperatures Theat and Tpress modified for the specific heat capacity c, as follows:

$$Theat=m(c)*Tpress+b(c) \quad \text{Eq. 2.4}$$

Applying the equation Eq. 2.4 above gives a corrected heating temperature Theat for a specific heat capacity c of a recording sheet S in use. Such modification to the correlation between the optimal heating temperature Theat and the operational temperature Tpress based on the specific heat capacity c allows for adjusting the amount of heat applied through the fixing nip N as the fixing device 20 processes different recording sheets S of different heat capacities c, resulting in an effective feedback heating control to maintain a constant post-fixing temperature regardless of changes in the operational conditions.

Figure 26:
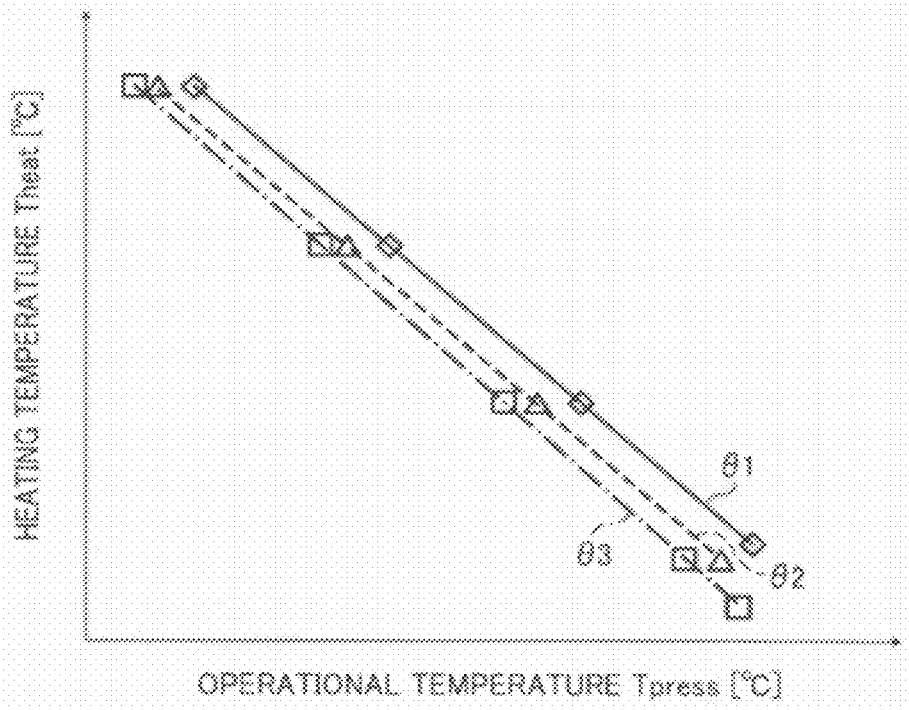
FIG. 26 shows graphs of optimal heating temperatures in degrees Celsius required to maintain a constant post-fixing temperature, plotted against the operational temperature in degrees Celsius of the pressure roller in the fixing device.

FIG. 26 shows graphs of optimal heating temperatures Theat in degrees Celsius required to maintain a constant post-fixing temperature Tpf, plotted against the operational temperature Tpress in degrees Celsius of the pressure roller 2, wherein a solid line labeled "θ1" represents values obtained with a moisture content of 9%, a broken line labeled "θ2" represents values obtained with a moisture content of 6%, and a dash-dotted line labeled "θ3" represents values obtained with a moisture content of 3%, each value being measured with a nip time of 50 msec, using a recording medium of a basis weight of 80 g/$m^2$, a thermal conductivity of 0.16 W/(m*K), a specific heat capacity of 1,012 kJ($m^3$*K), and an initial, pre-fixing temperature of 23° C.

As shown in FIG. 26, the heating temperature Theat linearly decreases as the operational temperature Tpress of the pressure roller 2 increases, as is generally defined by a linear function presented earlier as the equation Eq. 2.

Note that, as is the case with the lines t1 through t3 of FIG. 21, the lines θ1 through θ3 represent linear functions having different negative slopes m and different y-intercepts b, indicating dependency of these constants on the moisture content θ of a recording sheet S.

In particular, the magnitude of slope m of the linear function Eq. 2 is negatively, if slightly, associated with the moisture content θ, wherein the slope m of the linear function, in absolute value, is largest for the moisture content of 3% and smallest for the moisture content of 9%, which indicates that the smaller the moisture content θ, the greater the effect of the pressure roller temperature Tpress on the heating temperature Theat, and the resulting post-fixing temperature Tpf. Such a relation between the moisture content θ and the effect of the pressure roller temperature Tpress is attributable to the fact that a reduced moisture content θ of recording sheet results in an increased apparent conductivity of the recording sheet S, leading to an accelerated conduction of heat from the pressure roller 2 to the recording sheet S through the fixing nip N.

Thus, the slope and the y-intercept of the linear function Eq. 2 can be represented by θ-dependent functions m(θ) and b(θ), respectively, the value of each of which is determined by the moisture content θ of a recording sheet S.

In the feedback heating control according to this patent specification, specific O-dependent functions m(θ) and b(θ), or coefficients of these equations, determined experimentally or through simulation are stored in the memory for later retrieval. Specific values of moisture content θ may be derived, for example, from user-specified information or through measurement using an appropriate sensor. Substituting a moisture content θ into these functions m(θ) and b(θ) gives specific values of m and b, which in turn are substituted into the equation Eq. 2 to yield a correlation between the temperatures Theat and Tpress modified for the moisture content θ, as follows:

$$Theat=m(\theta)*Tpress+b(\theta) \quad \text{Eq. 2.5}$$

Applying the equation Eq. 2.5 above gives a corrected heating temperature Theat for a specific moisture content θ of a recording sheet S in use. Such modification to the correlation between the optimal heating temperature Theat and the operational temperature Tpress based on the moisture content θ allows for adjusting the amount of heat applied through the fixing nip N as the fixing device 20 processes different recording sheets S of different moisture contents θ, resulting in an effective feedback heating control to maintain a constant post-fixing temperature regardless of changes in the operational conditions.

In further embodiments, in stead of using a single operational parameter, the fixing device 20 according to this patent specification may adjust the heating temperature Theat based on a composite operational parameter α obtained by combining two or more operational parameters including, for example, a nip dwell time t, basis weight w, thermal conductivity λ, specific heat capacity c, and moisture content θ of a recording sheet in use, each of which may be obtained through measurement with a sensor, or derived from user-specified information stored in an appropriate memory.

Figure 27A:
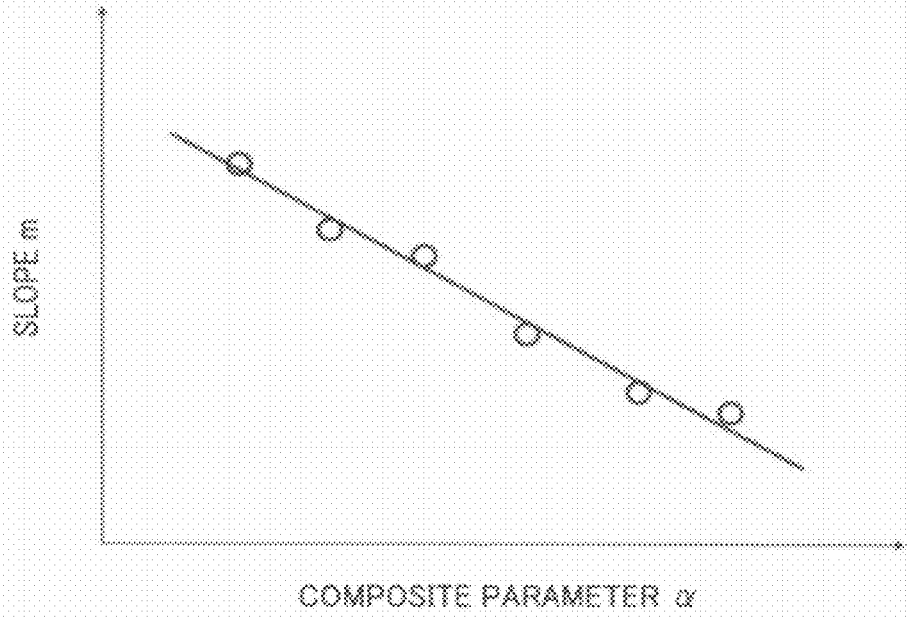
FIGS. 27A and 27B are graphs for illustrating a composite operational parameter associated with a linear function correlating the optimal heating temperature and the operational temperature of the pressure member in the fixing device, the former showing a relation between the slope of the linear function and the composite parameter, and the latter showing a relation between the y-intercept of the linear function and composite parameter.
Figure 27B:
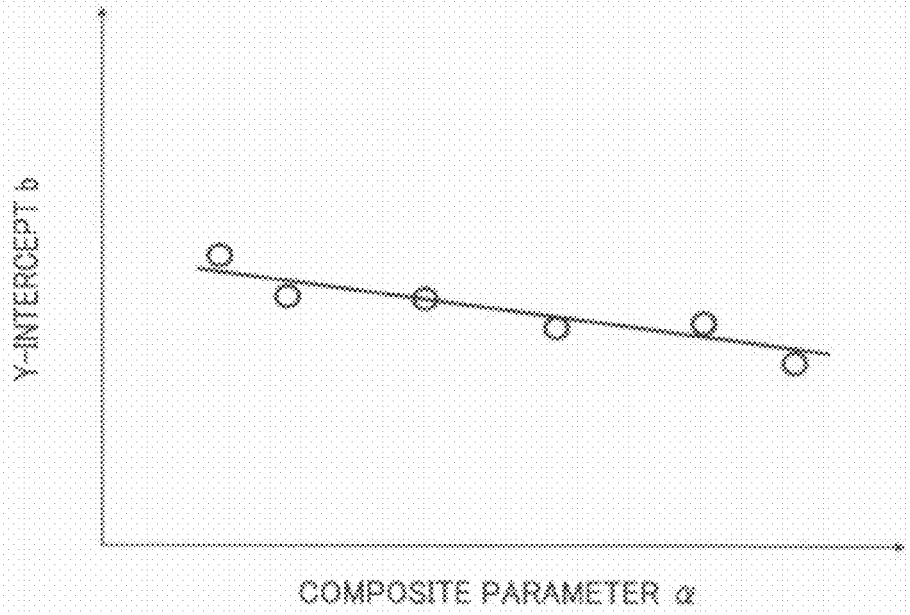

The composite parameter α may be any arithmetic combination of operational parameters, which is determined to be significantly associated with each of the magnitude of the slope m and the y-intercept m of the linear function Eq. 2, as shown in FIGS. 27A and 27B. Such composite parameter α may be obtained, for example, through estimation based on multiple regression analysis which involves multiple operational parameters determining the effect of the pressure roller temperature Tpress on the post-fixing temperature Tpf. Combined use of multiple operational parameters allows for more precise calculation of a post-fixing temperature Tpf based on a measured operational temperature Tpress of the pressure member 2, compared to correction using a single operational parameter.

Specifically, one example of composite operational parameter α is obtained by dividing the thermal conductivity λ by the basis weight w of a recording sheet S in use, as follows:

$$\alpha=\lambda/w \quad \text{Eq. 5}$$

Figure 28A:
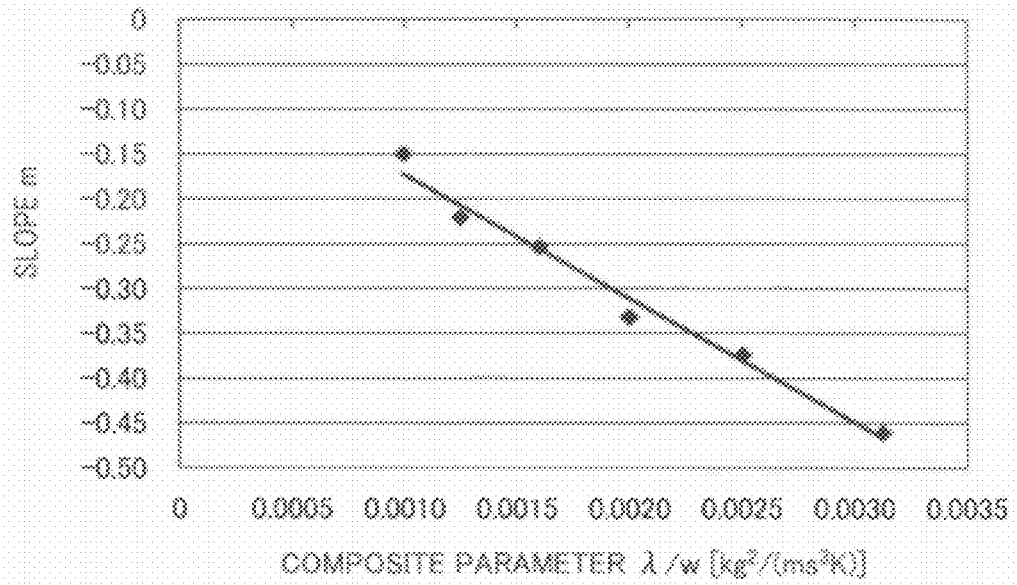
FIGS. 28A and 28B are graphs for illustrating a specific composite operational parameter associated with a linear function correlating the optimal heating temperature and the operational temperature of the pressure member in the fixing device, the former showing a relation between the slope of the linear function and the composite parameter, and the latter showing a relation between the y-intercept of the linear function and composite parameter, deduced from experiments.
Figure 28B:
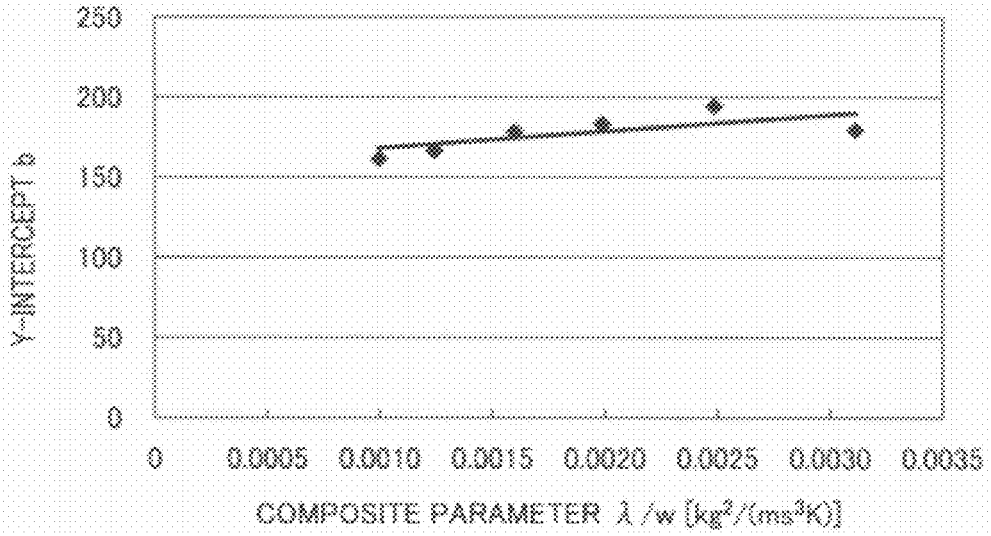

FIGS. 28A and 28B are graphs showing the slope m and the y-intercept b, respectively, of the linear function Eq. 2, plotted against the composite operational parameter λ/w in $kg^2/(m*s^3*K)$, deduced from experiments in which recording sheets S having a specific heat capacity of 1,012 $kJ/(m^3*K)$, a moisture content of 4%, and different thermal conductivities λ and basis weights w, were processed at a nip dwell time of 50 msec.

As shown in FIGS. 28A and 28B, the experimental data includes a total of six measurements obtained with varying values of composite parameter λ/w: 0.00100 with a thermal conductivity λ of 0.1 W/(m*K) and a basis weight w of 100 $g/m^2$; 0.00125 with a thermal conductivity λ of 0.1 W/(m*K) and a basis weight w of 80 $g/m^2$; 0.00160 with a thermal conductivity λ of 0.16 W/(m*K) and a basis weight w of 100 $g/m^2$; 0.00200 with a thermal conductivity λ of 0.1 W/(m*K) and a basis weight w of 80 $g/m^2$; 0.00250 with a thermal conductivity λ of 0.25 W/(m*K) and a basis weight w of 100 $g/m^2$; and 0.00313 with a thermal conductivity λ of 0.25 W/(m*K) and a basis weight w of 80 $g/m^2$.

As is the case with each specific operational parameter, the absolute value of the slope m linearly increases with increasing composite operational parameter λ/w (FIG. 28A). Also, the y-intercept b linearly increases with increasing composite operational parameter λ/w (FIG. 28B). The relation between the variables m and λ/w, and that between the variables b and λ/w, may be represented by linear approximate equations, as those described above, for example, in equations Eqs. 3 and 4.

Thus, the slope and the y-intercept of the linear function Eq. 2 can be represented by a-dependent functions m(α) and b(α), the value of each of which is determined by the operational parameter α being an arithmetic combination of the thermal conductivity λ and the basis weight w of the recording medium in use.

In the feedback heating control according to this patent specification, specific α-dependent functions m(α) and b(α), or coefficients of these equations, determined experimentally or through simulation are stored in the memory for later retrieval. Substituting a operational parameter α into the functions m(α) and b(α) gives specific values of m and b, which in turn are substituted into the equation Eq. 2 to yield a correlation between the temperatures Theat and Tpress modified for the specific parameter α, as follows:

$$Theat=m(a)*Tpress+b(a) \quad \text{Eq. 2.6}$$

Applying the equation Eq. 2.6 gives a corrected heating temperature Theat for a specific composite operational parameter α with which a recording sheet S in use is processed through the fixing nip N. Such modification to the correlation between the optimal heating temperature Theat and the operational temperature Tpress based on the composite parameter α allows for adjusting the amount of heat applied through the fixing nip N as the fixing device 20 processes different recording sheets S of different thermal conductivities λ and different basis weights w, resulting in an effective feedback heating control to maintain a constant post-fixing temperature regardless of changes in the operational conditions.

Although in several embodiments described above, the controller adjusts the amount of heat applied through the fixing nip by modifying the correlation between the optimal heating temperature Theat and the post-fixing temperature Tpf, such adjustment may also be accomplished by modifying the correlation between the optimal conveyance speed V and the post-fixing temperature Tpf based on one or more operational parameters.

Also, although in the embodiments described above with reference to FIGS. 28A and 28B, the composite parameter α is obtained by dividing the thermal conductivity λ by the basis weight w, modification to the correlation function may also be performed otherwise than specifically described herein using any combination of two or more operational parameters. Using such composite parameters a allows for more precise, effective adjustment of heating temperature than that possible with a single operational parameter, leading to more consistent and improved imaging quality and reduced power consumption in the fixing device.

To recapitulate, the fixing device 20 according to this patent specification can control heat application through the fixing nip N so as to process a recording medium S with consistent and consistently good imaging quality and high thermal efficiency, wherein the controller 10, operatively connected with the thermometer 7 disposed outside the fixing nip N to measure an operational temperature Tpress of the pressure member 2 indicative of a heat capacity of a recording medium S in use, optimizes a heating temperature Theat to which the fuser member 3 is heated according to the detected temperature Tpress for the specific type of recording medium S being processed, so that the recording medium S exhibits a substantially constant post-fixing temperature Tpf downstream from the fixing nip N regardless of the heat capacity of the recording medium S in use. The image forming apparatus 100 incorporating the fixing device 20 also benefits from feedback heating control according to this patent specification.

Although in several embodiments depicted above, the image forming apparatus is configured as a tandem color printer that employs four imaging stations arranged sequentially along an intermediate transfer belt, alternatively, instead, the feedback heating control according to this patent specification may be applicable to any type of imaging system that includes a pair of opposed rotary members disposed opposite to each other to form a nip therebetween, in particular, one that incorporates a fixing capability to fix a toner image in place on a recording medium conveyed thorough a fixing nip.

For example, the printer section may employ any number of imaging stations or primary colors associated therewith, e.g., a full-color process with three primary colors, a bi-color process with two primary colors, or a monochrome process with a single primary color. Further, instead of a tandem printing system, the printing section may employ any suitable imaging process for producing a toner image on a recording medium, such as one that employs a single photoconductor surrounded by multiple development devices for different primary colors, or one that employs a photoconductor in conjunction with a rotary or revolver development system rotatable relative to the photoconductive surface. Furthermore, the image forming apparatus according to this patent specification may be applicable to any type of electrophotographic imaging systems, such as photocopiers, printers, facsimiles, and multifunctional machines incorporating several of such imaging functions.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device for fixing a toner image printed on a recording medium having a specific heat capacity, the fixing device comprising:

a rotatable fuser member subjected to heating;

a heater to heat the fuser member to a heating temperature;

a rotatable pressure member disposed opposite the fuser member;

the fuser member and the pressure member pressed against each other to form a fixing nip therebetween, through which the recording medium is conveyed with a first, printed surface thereof facing the fuser member and a second, non-printed surface thereof facing the pressure member, so as to fix the toner image in place under heat and pressure as the fuser and pressure members rotate together;

a thermometer disposed adjacent to the pressure member to detect an operational temperature of the pressure member;

a feedback controller operatively connected with the thermometer to control the heating temperature according to the detected operational temperature, so that the recording medium exhibits a substantially constant post-fixing temperature downstream from the fixing nip regardless of the heat capacity of the recording medium; and a memory configured to store a lookup table or mathematical formula, which associates a specific operational temperature of the pressure member with a heating temperature for maintaining the post-fixing temperature of the recording medium at a set temperature, the memory being connected to the feedback controller, wherein the temperature of the pressure member is detected by the thermometer during passage through the fixing nip for every type of a recording medium having any value of a heat capacity and a basis weight, and based on the temperature thus obtained, a setpoint temperature of the fuser member is determined, wherein the feedback controller adjusts the heating temperature based on an operational parameter with which the recording medium in use is processed through the fixing nip, wherein with regards to an adjustment of a slope of the setpoint temperature of the fuser roller relative to the detected temperature of the pressure roller, the temperature of the fuser roller is corrected by at least one operational parameter, wherein the operational parameter includes a composite parameter obtained by combining at least two of nip dwell time, basis weight, thermal conductivity, specific heat capacity, and moisture content of the recording medium in use, and wherein the composite parameter is obtained by dividing the thermal conductivity by the basis weight.

2. The fixing device according to claim 1, wherein the feedback controller maintains the post-fixing temperature within 5° C. from a setpoint temperature.

3. The fixing device according to claim 1, wherein the feedback controller maintains the post-fixing temperature in a range from approximately 120° C. to approximately 140° C.

4. The fixing device according to claim 1, wherein the pressure member has no dedicated heater disposed adjacent to the pressure member.

5. A method for use in a fixing device that fixes a toner image printed on a recording medium having a specific heat capacity, the fixing device including a rotatable fuser member subjected to heating to a heating temperature, and a rotatable pressure member disposed opposite the fuser member, the fuser member and the pressure member pressed against each other to form a fixing nip therebetween;

the method comprising:

conveying the recording medium under heat and pressure through the fixing nip;

detecting an operational temperature of the pressure member during passage of the recording medium through the fixing nip;

controlling the heating temperature according to the detected operational temperature, so that the recording medium exhibits a substantially constant post-fixing temperature downstream from the fixing nip regardless of the heat capacity of the recording medium;

storing in a memory, a lookup table or mathematical formula that associates a specific operational temperature of the pressure member with a heating temperature for maintaining the post-fixing temperature of the recording medium at a set temperature, the memory being connected to the controlling of the heating temperature;

detecting the temperature of the pressure member by a thermometer during passage through the fixing nip for every type of a recording medium having any value of a heat capacity and a basis weight, and based on the temperature thus obtained, determining a setpoint temperature of the fuser member; and adjusting the heating temperature based on an operational parameter with which the recording medium in use is processed through the fixing nip, wherein with regards to an adjustment of a slope of the setpoint temperature of the fuser roller relative to the detected temperature of the pressure roller, the temperature of the fuser roller is corrected by at least one operational parameter, wherein the operational parameter includes a composite parameter obtained by combining at least two of nip dwell time, basis weight, thermal conductivity, specific heat capacity, and moisture content of the recording medium in use, and wherein the composite parameter is obtained by dividing the thermal conductivity by the basis weight.

6. An image forming apparatus, comprising:

an electrophotographic imaging unit to print a toner image on a recording medium having a specific heat capacity; and a fixing device to fix the toner image printed on the recording medium, the fixing device comprising:

a rotatable fuser member subjected to heating;

a heater to heat the fuser member to a heating temperature;

a rotatable pressure member disposed opposite the fuser member;

the fuser member and the pressure member pressed against each other to form a fixing nip therebetween, through which the recording medium is conveyed with a first, printed surface thereof facing the fuser member and a second, non-printed surface thereof facing the pressure member, so as to fix the toner image in place under heat and pressure as the fuser and pressure members rotate together;

a thermometer disposed adjacent to the pressure member to detect an operational temperature of the pressure member;

a feedback controller operatively connected with the thermometer to control the heating temperature according to the detected operational temperature, so that the recording medium exhibits a substantially constant post-fixing temperature downstream from the fixing nip regardless of the heat capacity of the recording medium; and a memory configured to store a lookup table or mathematical formula, which associates a specific operational temperature of the pressure member with a heating temperature for maintaining the post-fixing temperature of the recording medium at a set temperature, the memory being connected to the feedback controller, wherein the temperature of the pressure member is detected by the thermometer during passage through the fixing nip for every type of a recording medium having any value of a heat capacity and a basis weight, and based on the temperature thus obtained, a setpoint temperature of the fuser member is determined, wherein the feedback controller adjusts the heating temperature based on an operational parameter with which the recording medium in use is processed through the fixing nip, wherein with regards to an adjustment of a slope of the setpoint temperature of the fuser roller relative to the detected temperature of the pressure roller, the temperature of the fuser roller is corrected by at least one operational parameter, wherein the operational parameter includes a composite parameter obtained by combining at least two of nip dwell time, basis weight, thermal conductivity, specific heat capacity, and moisture content of the recording medium in use, and wherein the composite parameter is obtained by dividing the thermal conductivity by the basis weight.

7. The fixing device according to claim 1, wherein the composite parameter is obtained through estimation based on multiple regression analysis including multiple operational parameters determining an effect of the pressure roller temperature on the post-fixing temperature.

* * * * *